US007379023B2

(12) United States Patent
Yamanaka et al.

(10) Patent No.: US 7,379,023 B2
(45) Date of Patent: May 27, 2008

(54) ANTENNA DEVICE, RADIO-WAVE RECEIVER AND RADIO-WAVE TRANSMITTER

(75) Inventors: Kazunori Yamanaka, Isehara (JP); Masafumi Shigaki, Kawasaki (JP); Isao Nakazawa, Machida (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 11/454,197

(22) Filed: Jun. 16, 2006

(65) Prior Publication Data

US 2007/0001910 A1 Jan. 4, 2007

Related U.S. Application Data

(63) Continuation of application No. PCT/JP03/16235, filed on Dec. 18, 2003.

(51) Int. Cl.
*H01Q 1/38* (2006.01)

(52) U.S. Cl. ..... 343/700 MS; 343/701

(58) Field of Classification Search ..... 343/700 MS, 343/701, 772, 776, 872; 324/248
See application file for complete search history.

(56) References Cited

U.S. PATENT DOCUMENTS 5,105,200 A * 4/1992 Koepf ..... 343/700 MS
2006/0145694 A1* 7/2006 Oppenlander et al. ..... 324/248

FOREIGN PATENT DOCUMENTS

GB 2 303 491 A 2/1997
JP 5-7027 A 1/1993
JP 5-129823 A 5/1993
JP 10-242745 A 9/1998
JP 2000-500271 A 1/2000
JP 2000-236206 A 8/2000
JP 2000-251819 A 9/2000
JP 2001-16027 A 1/2001
JP 2003-046325 A 2/2003
JP 2003-46325 A 2/2003
JP 2003-523676 A 8/2003
WO WO 01/26183 A1 4/2001

OTHER PUBLICATIONS

Matthias Hein, "High-Temperature-Superconductor Thin Films at Microwave Frequencies", Springer Tracts in Modern Physics, pp. 92-93, 1999.

(Continued)

*Primary Examiner*—Hoanganh Le
(74) *Attorney, Agent, or Firm*—Westerman, Hattori, Daniels & Adrian, LLP.

(57) ABSTRACT

An antenna device includes a plane-type antenna element, a heat insulation container for blocking heat entering from the outside, the heat insulation container having a radio-wave window allowing a radio wave to pass therethrough, and housing the plane-type antenna element, a waveguide housed in the heat insulation container and arranged between the radio-wave window and an antenna pattern formation surface of the plane-type antenna element, and cooling means for cooling the plane-type antenna element. The waveguide is shaped and dimensioned so that the directivity of the plane-type antenna element is enhanced, and a superconducting film is used for the antenna pattern of the plane-type antenna element.

20 Claims, 26 Drawing Sheets

OTHER PUBLICATIONS

Alan M. Portis, "Electrodynamics of High-Temperature Superconductors", World Scientific, Lecture Notes in Physics, vol. 48, pp. 8-9, 1992.

Zhi-Yuan Shen, "High-Temperature Superconducting Microwave Circuits", Artech House, pp. 134-145, 1994.

Hideo Suzuki et al., "Strato-Mesospheric Ozone Monitoring System Using an SIS Mixer", IEICE Trans. Electron, vol. E79-C, No. 9, pp. 1219-1227, Sep. 1996.

Yoshinori Uzawa et al., "Quasi-Optical SIS Mixers with Nb/AIO$_x$/Nb Tunnel . . . ", IEICE Trans. Electron, vol. E79-C, No. 9, pp. 1237-1241, Sep. 1996.

Morishige Hieda et al., "A 270 GHz-Band Planer Type MMIC Image Rejection SIS Mixer", IEICE Trans. Electron, vol. E86-C, No. 8, pp. 1458-1463, Aug. 2003.

International Search Report mailed Mar. 2, 2004 of International Application PCT/JP2003/016235.

European Search Report dated Aug. 30, 2007, issued in corresponding European Application No. 03 78 0882.

Richard M. A. et al., "Superconducting Microstrip Antennas: An Experimental Comparison of Two Feeding Methods" vol. 41, No. 7, Jul. 1, 1993, XP000393451.

Spencer D. G., Novel Millimeter ACC Antenna Feed, pp. 411-419, Mar. 10, 2000, XP002160302.

* cited by examiner

ANTENNA DEVICE, RADIO-WAVE RECEIVER AND RADIO-WAVE TRANSMITTER

TECHNICAL FIELD

The present invention relates to an antenna device, a signal receiver, and a signal transmitter, each employing an antenna element made of a superconducting material and having a micro-strip coplanar structure. More specifically, the present invention relates to an antenna device, a signal receiver, and a signal transmitter for enhancing directivity gain. The present invention also relates to an antenna device, a signal receiver, and a signal transmitter, each incorporating a miniaturized design. The present invention further relates to an antenna device, a signal receiver, and a signal transmitter, each having a low-power consumption cooling system.

BACKGROUND ART

A demand for high-speed and compact design communication systems is mounting as radio LAN, satellite communications, and IMT-2000 advance. Along with this demand, performance increase and compact design are required of elements forming a communication system, such as antenna, filters, amplifiers, etc. Since the antenna is arranged at the front end of a receiver and a transmitter of a system, an increase in radio-wave transmission efficiency and an increase in radio-wave reception gain of the antenna lead to compact design and substantial improvement in communication characteristics of the entire system.

The radio-wave transmission efficiency and the radio-wave reception gain need to be increased. To improve general performance, power loss in high-frequency regions in a conductor portion of a high-frequency device containing an antenna element is preferably reduced. To efficiently increase performance, directivity gain is preferably increased.

The use of a low-resistance superconducting material has been proposed to reduce power loss in high-frequency regions. To realize the idea of using a superconducting material for an antenna device, a heat insulation unit and a cooling unit must be incorporated. The superconducting antenna element needs to be kept at a stabilized cooled state.

An antenna device as an known example 1 is described with reference to FIG. 1. A container of the antenna device of FIG. 1 includes an antenna window 5 and a jacket 6. A window material made of a dielectric material, and having a lens-like configuration in cross section is fitted into the antenna window 5.

The jacket 6 of the antenna device includes an RF connector 1, a cable 2, a micro-strip antenna 3, and a cold stage 4. These elements together with the jacket 6 form the antenna device. The micro-strip antenna 3 is made of a superconducting material.

A vacuum pump is attached to the antenna device. The interior of the jacket 6 of the antenna device is substantially vacuumed, and the micro-strip antenna 3 is heat insulated from the outside while also being cooled by a cold stage 4.

The distance between the antenna window and the micro-strip antenna 3 is set to be a predetermined distance determined by a specific dielectric constant, the thickness and the shape of the lens-like window material fitted into the antenna window 5. (See Patent Document 1.)

Referring to FIG. 2, a stratosphere-mesosphere ozone monitoring system is described. Referring to FIG. 2, there are shown a rotatable dish antenna 408, a λ/4 plate 409 phase shifting a portion of a radio wave received by the dish antenna 408 by a quarter wavelength, a fixed mirror 410 reflecting a radio wave passing through the λ/4 plate, a first oscillator 427, a heat-insulation dewar 429, a waveguide 415, a CGC (cross guide coupler) 416 coupled to the waveguide 415, a SIS (superconductor insulator superconductor) mixer 417, an intermediate-frequency amplifier 418, a cooling load 419, a radiation shield 420, a second oscillator 411, a third oscillator 412, an intermediate-frequency signal processor device 413, an AOS (Acouto-optical Spectrometer) 414, a reference oscillator 424, and a personal computer 425. The elements of FIG. 2, except the second oscillator 411, the third oscillator 412, the AOS 141, the personal computer 425, and the reference oscillator 424, form a main receiver unit 428. The first oscillator includes a frequency multiplier 421, a harmonic mixer 423, a phase-locked controller 426, and a Gunn oscillator 422. (see Non-patent Document 1)

Patent Document 1

Japanese Unexamined Patent Application Publication No. 2003-46325

Non-patent Document 1

Hideo Suzuki et. al. IEICE TRANS. ELECTRON., Vol. E79-C, No. 9, Sep., P 1219–1227, 1996

DISCLOSURE OF INVENTION

Problems to be Solved by the Invention

A temperature as low as several tens of degree K is required to cool an antenna element to improve antenna performance when the antenna of a superconducting material is used. To achieve such a low temperature, a cooling device using a helium gas as a medium and a vacuum jacket for heat insulating a low-temperature operating element and a circuit are required.

In the vacuum jacket, major emphasis is placed on a mechanical strength withstanding vacuum encapsulation, and a radio-wave transmissivity with the lowest possible attenuation involved when a received radio-wave reaches an antenna element, and when a radio-wave is transmitted from the antenna element. As a result, a directivity gain of the antenna element becomes less important.

In the known example 1, the ratio of the specific dielectric constant of the dielectric material to the specific dielectric constant of the interior of a vacuum device is set to be a predetermined value using a dielectric material in a window section of the vacuum device or the cross-sectional shape of the dielectric material is lens-configured. The window section thus has a lens effect. If the distance between the antenna window and the antenna element satisfies the relationship of [Equation 1], the directivity gain is improved during the reception of radio transmission and reception.

Improvements in the directivity gain of the antenna element are important, and from a different point of view, there is a need for improvement means improving the directivity gain of the antenna element.

$$t1\cdot(\in 1)^{1/2}+t2(\in 2)^{1/2}=(2n-1)\cdot\lambda/4 \qquad \text{[Equation 1]}$$

t1: Thickness of the dielectric material fitted into the antenna window t2: Distance from the underside of the dielectric material fitted into the antenna window to the antenna element

∈1: Dielectric constant of the dielectric material fitted into the antenna window ∈2: Dielectric constant of the space from the underside of the dielectric material fitted into the antenna window to the antenna element λ: Wavelength of the radio wave In a hybrid antenna, a plurality of antenna elements are operatively driven so that the plurality of antenna elements result in improvements in directivity. If intervals between antenna elements are assured to prevent interference between the antenna elements, a container housing the plurality of antenna elements becomes bulky. If an antenna pattern of the antenna element is made of a superconducting material, a heat-insulation vacuum device and a cooling device for maintaining a low-temperature state are required, leading to a bulky size of the entire antenna device.

The problems associated with the vacuum device and heat insulation are discussed here. The vacuum device effectively blocks heat inflow through heat conduction via a solid object and heat conduction via a gaseous body. However, heat inflow through heat radiation from a vacuum container cannot be prevented. The heat radiation from the vacuum container is proportional to the difference between the absolute temperature of the ambient air to the fourth power and the absolute temperature of the cooled element to the fourth power as described by the Stefan-Boltzmann law of [Equation 2]. If a heat insulation material such as a metal sheet or a polyester film having a metal film is contained in the vacuum container, pass of the received radio wave and the transmission of the radio wave can be adversely affected.

$$q=\sigma\cdot\kappa\cdot(To^4-Ts^4) \quad \text{[Equation 2]}$$

σ: Stefan-Boltzmann constant (5.669×10E-12 $w\cdot cm^{-2}K^{-4}$)

κ: Coefficient relating to radiation rate (dependent on material)

q: Heat flux

To: Absolute temperature of the ambient air

Ts: Absolute temperature of the element

A typical heat insulation problem may arise. For example, if a large transparent section such as an antenna window is present in a vacuum container, heat is transferred to the antenna element through heat radiation. This can cause an increase in the load on the cooling device, leading to an increase in power consumption of the cooling device. Power feeding and the cooling device under limited installation conditions present difficulty in cooling. Realizing an antenna device incorporating an antenna element having an antenna pattern made of a superconducting material is disadvantageous in terms of compact design and low power consumption. If the CGC 416 is coupled to the waveguide 415 to guide a radio wave from the dish antenna 408 as in the known example 2, heat radiation received by the waveguide 415 is also transferred to the CGC 416. Load on a device for cooling the CGC 416 can be even more increased.

Even the antenna device is cooled down into a superconducting state below the critical temperature using a superconducting material for the antenna element, a sufficiently low surface resistance cannot be achieved depending on the selection of a superconducting material and the state of crystallization of a superconducting film forming the antenna element.

To transmit and receive radio waves, a circuit forming a transmitter and a receiver, such as a filter circuit and an amplifier circuit, need to be attached to the antenna device. If these circuits are attached external to the vacuum device required to operate the antenna element in a stable manner, an attempt to incorporate the compact design in the transmitter and receiver may fail.

As means for solving the above-mentioned problems, a first invention provides an antenna device. The antenna device includes a plane-type antenna element, a heat insulation container for blocking heat entering from the outside, the heat insulation container having a radio-wave window allowing a radio wave to pass therethrough, and housing the plane-type antenna element, a waveguide housed in the heat insulation container and arranged between the radio-wave window and an antenna pattern formation surface of the plane-type antenna element and cooling means for cooling the plane-type antenna element.

Since the antenna device of the first invention cools the plane-type antenna element, a surface resistance of a conductor forming the plane-type antenna element is lowered, and the overall gain of the plane-type antenna element is increased.

Since the waveguide imparts directivity to the plane-type antenna element, the directivity gain of a radio wave transmitted is increased during transmission, and the directivity gain of a received radio wave is increased during reception.

In accordance with a second invention, to overcome the above-mentioned problem, the antenna device of the first invention includes the waveguide which is tubular. The height of the tubular waveguide is larger than the quotient that is obtained by dividing a quarter of the wavelength of a transmitted and received radio wave by $\sqrt{A}$ where A represents an effective specific dielectric constant between the opening of the waveguide and the antenna pattern formation surface of the plane-type antenna element. The surface of the waveguide having the opening is spaced from the antenna pattern formation surface of the plane-type antenna element, and wherein the distance between the surface of the waveguide having the opening and the antenna pattern formation surface of the plane-type antenna element is equal to or shorter than the quotient that is obtained by dividing a quarter of the wavelength of the received radio wave by $\sqrt{A}$. With the waveguide having the above-described shape and dimensions, the directivity gain of the plane-type antenna element in a vertical direction thereto is easily increased.

To overcome the above-mentioned problem, an antenna device of a third invention includes a plurality of plane-type antenna elements, a heat insulation container for blocking heat entering from the outside, the heat insulation container having a radio-wave window allowing a radio wave to pass therethrough, and housing the plurality of plane-type antenna elements, a waveguide housed in the heat insulation container and arranged between the radio-wave window and an antenna pattern formation surface of the plane-type antenna element, and cooling means for cooling the plane-type antenna elements. The waveguide is shaped and dimensioned so that the directivity of the plane-type antenna element is enhanced, and the plurality of plane-type antenna elements are operatively connected to each other.

Since the antenna device of the third invention cools the plane-type antenna element, a surface resistance of a conductor forming the plane-type antenna element is lowered, and the overall gain of each plane-type antenna element is increased.

Since the waveguide imparts directivity to the plane-type antenna element, the plane-type antenna elements are equally enhanced in directivity gain.

The antenna device includes the plurality of plane-type antenna elements. The plurality of plane-type antenna elements operatively connected function as a single hybrid antenna. As a result, the hybrid antenna provides improved directivity in comparison of the case in which each of individual plane-type antenna elements operates independently.

An antenna device of a fourth invention includes a plane-type antenna element, a heat insulation container for blocking heat entering from the outside, the heat insulation container having a radio-wave window allowing a radio wave to pass therethrough, and housing the plane-type antenna element, a first waveguide housed in the heat insulation container and arranged between the radio-wave window and an antenna pattern formation surface of the plane-type antenna element, a second waveguide external to the heat insulation container and arranged in a manner such that one opening of the second waveguide is in contact with the radio-wave window, and cooling means for cooling the plane-type antenna element. The first waveguide and the second waveguide enhance the directivity of the plane-type antenna element.

In the antenna device of the fourth invention, the second waveguide causes the radio wave to converge, and increases the directivity gain during transmission and reception.

A radio-wave receiver of a fifth invention includes a plane-type antenna element, a reception signal processor circuit for processing a signal from a radio wave received by the plane-type antenna element, a heat insulation container for blocking heat entering from the outside, the heat insulation container having a radio-wave window allowing a radio wave to pass therethrough, and housing the plane-type antenna element and the reception signal processor circuit, a waveguide housed in the heat insulation container and arranged between the radio-wave window and an antenna pattern formation surface of the plane-type antenna element, and cooling means for cooling the plane-type antenna element and the reception signal processor circuit. The waveguide is shaped and dimensioned so that the directivity of the plane-type antenna element is enhanced.

Since the plane-type antenna element and the receiver circuit within the heat insulation container are cooled in the radio-wave receiver of the fifth invention, resistances of the plane-type antenna element and a conductor of the receiver circuit are lowered. The radio-wave receiver thus operates at a low power loss. Since the plane-type antenna element and the receiver circuit are housed in the heat insulation container, the radio-wave receiver is miniaturized.

A radio-wave transmitter of a sixth invention includes a plane-type antenna element, a transmission signal processor circuit for processing a signal to be carried by a radio wave transmitted by the plane-type antenna element, a heat insulation container for blocking heat entering from the outside, the heat insulation container having a radio-wave window allowing a radio wave to pass therethrough, and housing the plane-type antenna element and the transmission signal processor circuit, a waveguide housed in the heat insulation container and arranged between the radio-wave window and an antenna pattern formation surface of the plane-type antenna element, and cooling means for cooling the plane-type antenna element and the transmission signal processor circuit. The waveguide is shaped and dimensioned so that the directivity of the plane-type antenna element is enhanced.

Since the plane-type antenna element and the transmission signal processor circuit within the heat insulation container are cooled in the radio-wave transmitter of the sixth invention, resistances of the plane-type antenna element and a conductor of the transmission signal processor circuit are lowered. The radio-wave transmitter thus operates at a low power loss. Since the plane-type antenna element and the transmission signal processor circuit are housed in the heat insulation container, the radio-wave transmitter is miniaturized.

Advantages

The present invention provides a high directivity gain antenna device. The antenna device, the radio-wave receiver and the radio-wave transmitter of the present invention operate at a low power loss. In accordance with the present invention, the antenna device, the radio-wave receiver and the radio-wave transmitter, each incorporating the plane-type antenna element made of a plurality of superconducting materials, are miniaturized. In accordance with the present invention, the antenna device, the radio-wave receiver and the radio-wave transmitter, each incorporating the plane-type antenna element made of a superconducting material, are operable at a low power consumption.

BEST MODE FOR CARRYING OUT THE INVENTION

An antenna device in the best mode for carrying out the invention includes an antenna element on a substrate, a shield for electromagnetically shielding the antenna element on the substrate, a waveguide, a cooling device for cooling the antenna element, a vacuum pump (for example, a rotary pump, a turbo molecular pump, or a combination thereof), a container for the antenna element, and a heat insulation material disposed between the container of the antenna element and the antenna element.

The cooling device of the antenna element uses a cooling medium, thereby cooling a cold plate within the container of the antenna element. As a result, the cooling device of the antenna element can cool the antenna element via the cold plate, etc.

The vacuum pump is used to depressurize the interior of the container of the antenna element via a discharge port. As a result, the vacuum pump depressurizes the container of the antenna element to a substantially vacuum state (to 1×10E-2 torr if the rotary pump alone is used, or to 1×10E-5 to 1×10E-7 torr if the turbo molecular pump is used in combination).

The container of the antenna element includes a radio-wave window, a lid for the container of the antenna element, a housing of the container of the antenna element, an O-ring for sealing the air-tightness of the container, a cable for conducting a signal from the antenna element and the like, an radio-frequency RF connector for coupling the cable to the outside of the container, a discharge pipe connecting to the vacuum pump, and a cold plate forming a portion of the cooling device. The interior of the container of the antenna element is maintained at an air-tight state by the O-ring. The interior of the container is maintained at a vacuum state by the vacuum pump. The container of the antenna element in the depressurized state controls the heat inflow through heat conduction via a solid object or a gaseous body from the outside to the antenna element, and cooling of the antenna element is easily performed.

Since the heat insulation material is disposed between the container of the antenna element and the antenna element, heat inflow through heat radiation from the container of the antenna element to the antenna element is controlled.

An antenna pattern of the antenna element is made of a superconducting material, and a surface resistance of the antenna pattern shows a resistance lower than that of copper (Cu) below the critical temperature. In accordance with the present embodiment, the antenna pattern of the antenna element is formed on the surface of the substrate, and is of a plane-type. The present invention is not limited to the plane-type. The antenna pattern of the antenna element may have some degree of thickness, or may have a space structure. The space structure refers to a structure in which a substrate includes a plurality of layers with antenna patterns formed in the respective layers.

The waveguide is arranged within the container of the antenna element, and disposed between the antenna element and the lid of the container-of the antenna element. The waveguide is fixed to the container of the antenna element and grounded via the container of the antenna element. There is no thermal contact via a solid body or a gaseous body between the waveguide and the antenna element. The height of the waveguide falls within a range that increases the directivity gain in the emission of the radio wave from the antenna element, and is preferably within a range from the wavelength of the radio wave transmitted from the antenna element to a quarter of the wavelength of the radio wave.

The antenna element in the best mode for carrying out the invention provides the following advantages. Since the effect of the waveguide imparts directivity to the radio wave transmitted from the antenna element, the directivity gain of the antenna element is increased.

Since the radio wave passing through the radio-wave window of the container of the antenna element is guided by the waveguide to the immediately close position to the antenna element without any leakage, loss of the radio wave in the container of the antenna element is prevented. The directivity gain of the antenna element is increased during reception.

Even if the heat insulation material is disposed in the container of the antenna element, the waveguide and the shield prevent the transmitted radio wave from leaking from the antenna element to the heat insulation material. The radio wave is thus transmitted through the radio-wave window with directivity. Since passing of the received radio wave to the antenna element is assured, loss of the radio wave due to the heat insulation material is controlled.

Since the heat insulation material within the container of the antenna element controls heat inflow through heat radiation from the container of the antenna element, no further load is applied on the cooling device of the antenna element. The cooling device can thus be miniaturized.

Embodiment 1

An antenna device 35 of an embodiment 1 is described with reference to FIGS. 3, 4, and 5. FIG. 3 is a sectional view of the antenna device. The antenna device 35 includes a substrate 26, antenna elements 20 on the substrate 26, waveguides 22, a shield 18, a vacuum valve 39, a vacuum pump 30, a container 34 for the antenna element, a cold plate 27, a pipe 31, a cooling medium 32, and a compressor 15.

From among the above-mentioned elements, the cold plate 27, the pipe 31, and the compressor 15 form a cooling device that uses adiabatic expansion of the cooling medium 32, namely, based on the pulse tube principle or the Stirling cycle principle. The cooling device cools the substrate 26 on the cold plate 27, and the antenna elements 20 on the substrate 26.

The cooling medium 32 is typically a helium gas. Arranged between the cold plate 27 and the substrate 26 is a substance for enhancing heat conduction, such as a copper metal block, indium or grease for improving adherence.

As previously discussed, the type of the cooling device is the one based on the pulse tube principle or the Stirling cycle principle. The present invention is not limited to these. For example, a pipe is arranged within the cold plate 27 to circulate one of liquid helium and liquid nitrogen.

The antenna element container 34 includes a radio-wave window 21, a lid 24 for the container of the antenna element, a body 33 of the antenna element container 34, a lid O-ring 23, arranged between the lid 24 of the antenna element container 34 and a junction portion of the body 33, for maintaining air-tightness of the container, a cable 17 conducting signals input from outside the antenna element container 34 and output from the antenna element, a RF connector 16, a discharge port 28 coupled to a vacuum pump 30, and lock screws 25.

The radio-wave window 21 is used to receive a radio wave from outside the antenna element container 34 and transmit a radio wave from the antenna element container 34.

The RF connector 16 is used to connect an external cable to the cable 17 that conducts input and output signals between the antenna element and the outside, and handles high-frequency signals.

The lock screws 25 secure the antenna element container 34 to the lid 24 of the antenna element container 34.

The interior of the antenna element container 34 is sealed by the lid 24 to an airtight state.

The vacuum pump 30 is used to depressurize the interior of the antenna element container 34 via the discharge port 28 connected to the vacuum pump 30 and a vacuum valve 39. More specifically, the vacuum pump 30 depressurizes the interior of the antenna element container 34 to a vacuum state of 1×10E-2 through 1×10E-6 torr (hereinafter referred to as quasi-vacuum state). The discharge port 28 and the vacuum valve 39 are joined to each other using so-called metal shield, maintaining a high degree of airtightness.

If the O-ring such as the lid O-ring 23 is set to be metal seal grade, even higher airtightness is assured. If the procedure described below is followed, the above-mentioned quasi-vacuum state is maintained for a long period of time, and even the vacuum pump can be removed.

Step 1: The vacuum pump 30 is used to vacuum the interior of the container of the antenna element to a quasi-vacuum state.

Step 2: Means (not shown) for heating the interior of the antenna element container 34 to a temperature within a range of 70 to 105° C. is attached on one of the lid 24 and the body 33. Baking is performed using the heating means.

Step 3: A getter material (not shown) attached to the antenna element container, typically mounted within the vacuum container, is caused to function with the entire vacuum valve 39 of the antenna element closed.

In the antenna device 35 of FIG. 3 thus constructed, the antenna element container 34 in a depressurized state thus prevents heat inflow from the outside to the antenna element. The antenna element is cooled using the above-mentioned cooling device in a manner free from load added thereto.

The antenna device 35 of the embodiment 1 is described below in detail with reference to FIGS. 4 and 5. FIG. 4 is a perspective view of a portion of the antenna element container 34 of FIG. 3, and the interior thereof. The antenna element container 34 includes eight rectangular antenna elements 20, eight rectangular waveguides 22, each having a rectangular opening opened toward the side of a radio-wave window and an rectangular opening opened toward the side of the antenna element, a shield 18, a cold plate 27, eight cables 17 of the same number as the number of antenna elements (four cables not shown), eight RF connectors 16

(four RF connectors not shown), a lid 24, a radio-wave window 21, a cylindrical antenna element container 34, lock screws 25, and a body 33.

FIG. 5 is a top view of the container of the antenna element, and shows the positional relationship of the lid 24 of the antenna element container, the rectangular radio-wave window 21, the rectangular antenna elements 20, the rectangular openings of the waveguides 22, and the lock screws 25.

Referring to FIG. 4, the substrate 26 on which the antenna elements 20 are disposed is arranged on the disk-like cold plate 27. The shield 18 is arranged on the substrate 26, thereby covering the substrate 26.

The substrate 26 is a substrate made of a dielectric material. The substrate 26 "on which the antenna element 20 is disposed" means that an antenna pattern of the substrate 26 is formed on the substrate 26. If the antenna pattern has a strip-line structure, a metal electrode for ground potential is arranged on the backside of the substrate 26. The antenna pattern may be of a plane-type or may have a thickness. If the substrate 26 has a multi-layer structure, the antenna pattern may be formed in an intermediate layer. To electromagnetically shield the antenna element, the material of the shield 18 is a metal such as copper (Cu). The ground potential of the shield 18 is at the same level as the antenna element 20.

The antenna element 20 may have a micro-strip line structure or a coplanar structure, each having an antenna pattern such as a dipole type, a loop type, or a linear antenna type. A set of antenna patterns becomes rectangular. Eight antenna elements are arranged in a layout of two rows by four columns on the substrate. The antenna pattern is made of a superconducting material.

The rectangular-pole-like waveguide 22 includes an opening opened toward the side of the antenna element 20 and having a rectangular shape approximately identical in size and shape to the antenna element 20, and an opening opened toward the side of the radio-wave window 21 and having a rectangular shape approximately identical in size and shape to the antenna element 20. The waveguide 22 is thus arranged between the antenna element 20 and the radio-wave window 21. The one opening of the waveguide 22 faces the antenna element 20, but is spaced from the antenna element 20 and the shield 18. The other opening of the waveguide 22 faces the radio-wave window 21 and is connected to the lid 24 at the radio-wave window 21. In other words, the waveguide 22 is in solid-object thermal contact with and electrically connected to the antenna element container 34. The waveguide 22 is thus grounded via the antenna element container 34. However, there is neither heat conduction via a solid body between the waveguide 22 and each of the antenna element and the shield 18 nor heat conduction via a gaseous body between the waveguide 22 and each of the antenna element and the shield 18.

A hollow rectangular pole as the waveguide 22 is produced from a thin metal sheet having less thermal conductivity, for example, made of stainless steel (SUS304, SUS316 or the like), cupro-nickel, brass, or the like, with the inner surface of the rectangular pole plated with copper (Cu), silver (Ag), or gold (Au). Alternatively, a hollow rectangular pole as the waveguide 22 is produced from an insulating film with the inner surface thereof coated with a metal film of copper (Cu), silver (Ag), gold (Au), or the like, or with the outer surface thereof coated with a metal film of copper (Cu), silver (Ag), gold (Au), or the like.

The waveguide 22 is shaped and dimensioned so that the directivity of the antenna element 20 is enhanced as described below. The statement "directivity of the antenna element 20 is enhanced" means that an emitted radio wave strength or a received radio wave gain is increased at a predetermined direction with reference to directivity intrinsic of the antenna element 20, namely, angular dependency of the intensity of an emitted radio wave, and angular dependency of the intensity of a received radio wave.

The "increase of the directivity gain" in transmission refers to an increase of the ratio of an emitted power of a radio wave emitted in a particular direction to the sum of power of the radio wave emitted in all directions from the antenna element. The "increase of the directivity gain" in reception refers to an increase of the ratio of a received power of a radio wave received in a particular direction to the sum of power of the radio wave received in all directions to the antenna element. The "enhancement of directivity" intensifies power of the transmitted and received radio wave in a particular direction, thereby leading to the "increase of the directivity gain."

More specifically, the height of the waveguide 22 preferably falls within a range of about the wavelength of the radio wave transmitted and received by the antenna device of the embodiment 1 to about a quarter of the wavelength. If the height of the waveguide 22 is too small, no increase is expected in the directivity gain of the transmitted and received radio wave in the vertical direction. If the height of the waveguide 22 is too large, the transmitted and received radio waves traveling through the waveguide 22 are subject to a large loss, and an increase in the directivity gain of the transmitted and received radio waves is limited. However, the height of the waveguide 22 is not limited to about a quarter of the wavelength.

The length of the rectangular opening of the waveguide 22, facing the antenna element 20, along the long side of the opening, preferably falls within a range from about the wavelength of the transmitted and received radio wave to about half the wavelength of the radio wave. The lower limit of the range is set to half the wavelength because the length of the long side set to be equal to or less than about half the wavelength causes the transmitted and received radio wave to be cut off. The upper limit of the range is set to be about the wavelength because the length of the range set to be above the wavelength weakens the convergence of the transmitted and received radio wave and restricts an increase in the directivity gain of the transmitted and received radio wave.

In the vicinity of the surface of the substrate 26 having the antenna pattern of the antenna element, the transmitted and received radio wave is affected by a specific dielectric constant of the interior of the antenna element container 34 and a specific dielectric constant of the substrate 26. When traveling through the waveguide 22, the transmitted and received radio wave is affected by a specific dielectric constant of an interior of the waveguide 22. The "wavelength" discussed with reference to the embodiment 1 is a wavelength $\lambda_0/\sqrt{Ke}$ of an electromagnetic wave that is a transmitted and received radio wave at each location, where Ke represents an effective specific dielectric constant acting on an electromagnetic field caused by the transmitted and received radio wave and $\lambda_0$ represents a wavelength of the transmitted and received radio wave in vacuum (the definition of the wavelength remains unchanged unless otherwise the wavelength is redefined).

The "effective specific dielectric constant" is determined based on the following teaching. The dielectric constant is determined as a proportional coefficient (typically a tensor corresponding, to each element of a vector) of the electric flux density (vector) that is proportional to an electric field E (vector representing a direction and a length) in an electromagnetic mode used in space in which the dielectric constant is to be determined.

Typically, within a range affecting a space containing the space where the dielectric constant is to be determined, emitted electromagnetic field distribution within the range is directly numerically approximated, and then the dielectric constant is determined using an electromagnetic field simulator on a computer. More specifically, the dielectric constant is determined generally analyzing specific dielectric constants of a plurality of dielectric materials affecting the space, distance from the dielectric materials, or the shapes of the dielectric materials. The dielectric constant is the one the electromagnetic field resulting from the transmitted and received radio wave responds within the range of the space where the dielectric constant is to be determined.

In the case of a simple isotropic dielectric material, the mean (a scalar amount having only a magnitude) of energy of an electric field (vector) is approximately used, and the dielectric constant is represented as simple proportionality constants $\in \times \in_0$ ($\in$:specific dielectric constant of a given dielectric material and $\in_0$: dielectric constant of the vacuum).

When traveling through a metal-enclosed tubular waveguide, an electromagnetic wave propagates in $TE_{11}$ mode as one of basic electromagnetic field modes. The electric field at the opening surface of the waveguide has parallel components only. The dielectric constant of the dielectric material is considered from the parallel component only. The ratio of the dielectric constant thus determined to the dielectric constant of the vacuum becomes a specific dielectric constant.

More specifically, the dimension of the waveguide may be set to be about a quarter of the wavelength. The effective specific dielectric constant is determined by accounting for the effect of the waveguide itself at the mounting location of the waveguide. The wavelength is calculated from $\lambda_0/\sqrt{Ke}$ based on the specific dielectric constant, and the dimension of the waveguide is then determined. To easily learn the size of the metal-enclosed waveguide made of a uniform material, $\lambda_0/\sqrt{\in}$ can be used as a wavelength of the electromagnetic wave ($\lambda_0$: wavelength in the vacuum, and $\in$: specific dielectric constant in the waveguide).

Referring to the sectional view of FIG. 3 and the perspective view of FIG. 4, a rectangular window at the radio-wave window 21 is carved to a depth equal to half the thickness of the radio-wave window 21 from the outside of the lid 24. The rectangular window encloses of two rows by four columns openings of the waveguides 22. A transparent dielectric plate made of quartz, polytetrafluoroethylene, or the like, having a low thermal conductivity is fitted into the rectangular window. To maintain the quasi vacuum state, the plate is glued onto the lid 24 using an adhesive agent or a shield material. Small eight windows of two rows by four columns are arranged from the inside of the container, and receive the waveguides 22.

The antenna device 35 of the embodiment 1 provides the following advantages. Since the depressurized antenna element container 34 insulates the antenna elements from external heat, the cooling device including the cold plate 27 and the like can maintain the antenna element 20 at a low temperature for a long period of time. Since the surface resistance of the superconducting material forming the antenna elements 20 becomes low at a low temperature equal to or lower than the critical temperature, the gain of the antenna elements 20 is increased.

The effect of the waveguide 22 between the antenna element 20 and the radio-wave window 21 increases the directivity gain of the antenna element 20 during radio wave transmission.

Since the waveguide 22 guides the radio wave having passed through the radio-wave window 21 of the antenna element container 34 to the antenna element 20 without leakage, the loss of the radio wave-through the antenna element container 34 between the antenna element 20 and the radio-wave window 21 is prevented. During reception of the radio wave, the directivity gain of the antenna element 20 is increased.

Since the waveguides 22 are independently arranged one for each of the antenna elements 20, interference among the antenna elements 20 in the antenna element container 34 is prevented. The waveguides 22 do not prevent radio waves radiated from the antenna elements 20 from interfering each other outside the antenna element container 34.

Since there is no contact between the waveguide 22 and the antenna element 20, heat inflow from the waveguide 22 to the antenna element 20 through solid-body heat conduction is prevented. The load on the cooling means, such as the cold plate 27, cooling the antenna element 20, is reduced, permitting the cooling device and thus the entire antenna device to be miniaturized.

Embodiment 2

(Embodiment Incorporating a Radiation Heat Blocking Film in a Cooling Device)

An antenna device 40 of an embodiment 2 is described below with reference to FIG. 6. The antenna device 40 is identical in structure to the embodiment 1 except for a super insulation film 14.

The super insulation film 14 is constructed by laminating a plurality of layers, each layer composed of a metal film or a thin insulation polyester film as thick as about 10 μm with aluminum (Al) deposited thereon and nylon net. The net is arranged between the metal films or the insulation films in order to keep the metal films or the insulation films from being in contact with each other. The super insulation film 14 thus constructed has the effect of controlling heat inflow through heat radiation from the antenna element container 34 to the antenna element 20. The super insulation film 14 thus works as a heat insulation material.

The antenna device 40 of the embodiment 2 thus includes the super insulation film 14 between the antenna element 20 and the wall of the antenna element container 34 within the antenna element container 34, thereby preventing radiation heat from reaching from the antenna element container 34 to the antenna element 20.

With the super insulation film 14 blocking the radiation heat, the load on the cooling device including the cold plate 27 can be reduced. The cooling device can thus be miniaturized, and the entire antenna device is also miniaturized.

The waveguide 22 and the shield 18 increase the directivity gain of the radio wave transmitted from the antenna element 20 regardless of the distance between the antenna element 20 and the radio-wave window 21, and the presence of the super insulation film 14.

The waveguide 22 guides the radio wave having passed through the radio-wave window of the antenna element container 34 without leakage involved. Regardless of the distance between the antenna element 20 and the radio-wave window 21, the super insulation film 14 is prevented from blocking radio wave.

Embodiment 3

(Embodiment Incorporating an Antenna Element Having a Circular Antenna Pattern)

Embodiment 3 is described with reference to FIGS. 7 and 8. FIG. 7 is a perspective view illustrating a portion of the antenna device of the example 3. FIG. 8 is a top view of the antenna device of the embodiment 3. The elements of the antenna device of the embodiment 3 are different from those of the antenna device of the embodiment 1 in the following points.

FIGS. 7 and 8 show the differences in that the antenna pattern of an antenna element 48 forming the antenna device of the embodiment 3 is circular, that a small window of the inside surface of an antenna element container 52 of a radio-wave window 45 is circular, and that a waveguide 47 is a cylinder and has a circular opening opened toward the antenna element 48, having almost the same shape and size as the antenna pattern of the antenna element 48, and a circular opening opened toward the radio-wave window 45, having almost the same shape and size as the inner small window of the radio-wave window 45.

The antenna element 48, the radio-wave window 45, and the waveguide 47 have the following advantages in comparison with the corresponding elements in the antenna device of the embodiment 1.

The antenna element 48, although having the micro-strip structure, is different from the waveguide 22 in that the antenna element 48 has the circular antenna pattern. By placing the feeder point to the antenna pattern at a proper location, the antenna device can receive a circular polarized radio wave that the rectangular antenna pattern is unable to receive.

In another difference, the inner small window of the antenna element container 52 in the radio-wave window 45 is circular. Since the small window is reduced in area more than when the small window is square, the heat inflow through the radio-wave window 45 is reduced.

In yet another difference, the waveguide 47 is the cylinder and has the circular opening opened toward the antenna element 48, having almost the same shape and size as the antenna pattern of the antenna element 48, and the circular opening opened toward the radio-wave window 45, having almost the same shape and size as the inner small window of the radio-wave window 45. The wave guide 47 has the shape closely fitted into the small window of the radio-wave window 45 and the antenna pattern of the antenna element 48.

As described below, the antenna pattern of the antenna element 48, the waveguide 47, and the small window of the radio-wave window 45 are preferably related to each other in shape.

If the effective wavelength of the transmitted and received radio wave is $\lambda$, mutual current canceling is removed within the antenna pattern and the transmitted and received signal rises to a higher level. The diameter of the antenna pattern of the antenna element 48 of the embodiment 3 is preferably about $\lambda/2$.

The "effective wavelength" refers to the wavelength of the transmitted and received radio wave corresponding to the "effective specific dielectric constant" discussed with reference to the embodiment 1.

The diameter of the antenna pattern is preferably $\lambda_0/2/\sqrt{A}$ in view of the antenna element 48 formed on the substrate, where A represents an effective specific dielectric constant taking into consideration the specific dielectric constant of the interior of the antenna element container 52 and the specific dielectric constant of the substrate, and $\lambda_0$ represents the wavelength of the transmitted and received radio wave in the vacuum. The radio wave, having the wavelength $\lambda_0$ in the vacuum, has a wavelength $\lambda_0/\sqrt{E}$ when it travels in a substance having a specific dielectric constant E.

The diameter of the opening of the waveguide 47 is preferably about $\lambda/2$ if the effective wavelength is $\lambda$. Since the diameter of the antenna pattern of the antenna element 20 is $\lambda/2$, namely, $\lambda_0/2/\sqrt{A}$, loss in the radio wave is controlled.

Since the opening of the waveguide 47 is $\lambda_0/2/\sqrt{A}$, the small window on the inner surface of the radio-wave window 45 is also preferably about $\lambda_0/2/\sqrt{A}$.

The specific dielectric constant of the substrate forming the antenna device of the embodiment 3 may be approximately equal to the specific dielectric constant of the air, and a received radio wave may be 10 GHz. The wavelength of the received radio wave is 3 cm if the speed of light in the vacuum is about 3×10E8 m/s.

The size of each element of the antenna device of the embodiment 3 is determined based on the above conditions. For example, the small window of the radio-wave window 45 is about 1.5 cm. The radio-wave window 45 containing small windows of two rows by four columns has a size of 5×9 cm including spacings between the small windows. The antenna element container 52 containing the radio-wave window 45 is then a cylinder having a circular cross section of a diameter of 15 cm and a height of about 10 cm.

The height from the bottom surface of the antenna element container 52 to the top surface of the cold plate is about 5 cm. Since the thickness of the antenna element container 52 is about 1 cm, the waveguide 47 is a cylinder having a height of 1 to 3 cm with a bottom section being circular with a diameter of about 1.5 cm.

In addition to the advantages of the antenna device of the embodiment 1, the antenna device of the embodiment 3 with the circular antenna pattern of the antenna element 48 can capture a radio wave of a mode, which is difficult to capture with a rectangular antenna pattern. For example, the antenna device of the embodiment 3 captures a circular polarized radio wave.

Embodiment 4

(Embodiment Incorporating a Waveguide Made of a Dielectric Material)

An antenna device of an embodiment 4 is described below with reference to FIGS. 9, 10 and 11. FIG. 9 is a perspective view illustrating a portion of the antenna device of the embodiment 4. FIG. 10 is a top view of the antenna device of the embodiment 4. FIG. 11 is a perspective view of a waveguide 62 forming the antenna device of the embodiment 4.

The elements of the antenna device of the embodiment 4 are different from those of the antenna device of the embodiment 1 in the following points.

As shown in FIGS. 9 and 10 the antenna device of the embodiment 4 is different from the antenna device of the embodiment 1 in that a waveguide 62 forming the antenna device of the embodiment 4 is a cylinder tapered from an antenna element 63 to a radio-wave window 59, that the radio-wave window 59 is a small circular window, and that an antenna pattern of the antenna element 63 having a micro-strip line structure is circular.

A transparent plate having a specific dielectric constant $\in_1$ is fitted into the radio-wave window 59.

Let $\lambda_0$ represent the wavelength of a radio wave traveling in the vacuum, and the wavelength of the radio wave becomes $\lambda_0/\sqrt{\in_1}$ when the radio wave travels through the radio-wave window 59. The diameter of the circular radio-wave window 59 is preferably $\lambda_0/2/\sqrt{\in_1}$. If the diameter of the circular radio-wave window 59 is less than $\lambda_0/2/\sqrt{\in_1}$, passing of the radio wave is blocked according to theory of electromagnetism. If the diameter of the circular radio-wave window 59 is more than $\lambda_0/2/\sqrt{\in_1}$, heat inflow to the antenna element through heat radiation from the outside increases.

FIG. 11 is a perspective view of a waveguide 62 that is a cylinder tapered from the antenna element 63 to the radio-wave window 59. The diameter of an opening 62*a* of the waveguide 62 opened to the antenna element 63 is preferably larger than the diameter of a second opening 62*b* opened to the radio-wave window 59.

The waveguide 62 is a unitary body having a specific dielectric constant of $\in_1$, and a low-resistance metal such as silver (Ag), copper (Cu), gold (Au), or the like is deposited onto the outer circumference of the waveguide 62.

The reason why the waveguide 62 has preferably such a shape is discussed below. Since the specific dielectric constant of the plate fitted into the radio-wave window 59 and the specific dielectric constant of the waveguide 62 are $\in_1$, the effective specific dielectric constant of the waveguide 62 in the vicinity of the second opening 62*b* opened to the radio-wave window 59 is about $\in_1$ and the wavelength of the radio wave having passed through the radio-wave window 59 is $\lambda_0/2/\sqrt{\in_1}$. The diameter of the small circular window of the radio-wave window 59 is equalized with the diameter of the second opening 62*b* of the waveguide 62.

In the vicinity of the first opening 62*a*, the radio wave is affected by the specific dielectric constant of the interior of an antenna element container 55 in the quasi-vacuum, the specific dielectric constant of the substrate having the antenna element 63, and the specific dielectric constant of the waveguide 62. Let $\in_2$ represent an effective specific dielectric constant of the waveguide 62 in the vicinity of the first opening 62*a*, and the wavelength of the radio wave having passed through the waveguide 62 is expected to be $\lambda_0/2/\sqrt{\in_2}$. The diameter of the first opening 62*a* of the waveguide 62 is preferably $\lambda_0/2/\sqrt{\in_2}$.

Each of the specific dielectric constant of the interior of the antenna element container 55 and the specific dielectric constant of the substrate is smaller than the specific dielectric constant of the waveguide 62, and $\in_2$ is normally smaller than $\in_1$. Referring to FIG. 11, the waveguide 62 is preferably a cylinder with the first circular opening 62*a* having a diameter of $\lambda_0/2/\sqrt{\in_2}$ and with the second circular opening 62 having a diameter of $\lambda_0/2/\sqrt{\in_1}$.

To increase the directivity gain during the transmission of the radio wave from the antenna element 63, the height of the waveguide 62 preferably falls within a range of $\lambda_0/4/\sqrt{\in_1}$ to $\lambda_0/\sqrt{\in_1}$. If the height is too small, the directivity gain is not increased during the radio wave transmission. If the height is too large, the radio wave suffers from loss when the radio wave travels through the waveguide 62.

The shape of the antenna pattern of the antenna element 63 is simply determined chiefly taking into consideration the specific dielectric constant of the antenna element container 55 in the quasi-vacuum state and the specific dielectric constant of the substrate having the antenna element 63. Let $\in_3$ represent an effective specific dielectric constant, the diameter of the antenna pattern has preferably a circular shape having a diameter of $\lambda_0/2/\sqrt{\in_3}$. With the antenna pattern as large as half the wavelength of the radio wave in the vicinity of the antenna pattern, gain is increased in the radio wave transmission and reception.

The radio wave is affected more by the specific dielectric constant of the interior of the antenna element container 55 than the specific dielectric constant of the waveguide 62 in the vicinity of the antenna pattern of the antenna element 63. Since the specific dielectric constant of the interior of the antenna element container 55 is approximately equal to the specific dielectric constant of the vacuum, $\in_3$ is expected to be smaller than $\in_2$. If the area of the radio-wave window 59 and the area of the antenna pattern of the antenna element thus determined are compared, the area of the radio-wave window 59 is smaller.

The antenna device of the embodiment 4 provides the advantages similar to those of the antenna device of the embodiment 1. Because of the above difference, the area of the radio-wave window 59 is smaller the area of the antenna element 63. The antenna element 63 exposed to direct radiation heat from the outside via the radio-wave window 59 is thus smaller. The radio-wave window 59 thus shaped prevent the transmitted and received radio wave from diverging between the antenna element 63 and the radio-wave window 59.

As a result, the load on the cooling device including the cold plate 65 is reduced. The cooling device is thus miniaturized and the entire antenna device is accordingly miniaturized.

In the embodiment 4, the waveguide 62 is the cylinder with the circular opening opened toward the radio-wave window 59 smaller and the circular opening opened toward the antenna element 63 larger.

The waveguide 62 may be a cylinder having a uniform size equal to the opening opened toward the radio-wave window 59, namely, may be a constant-diameter cylinder with the circular opening opened toward the antenna element 63 equal to the circular opening opened toward the radio-wave window 59 in size and shape.

This is because the specific dielectric constant of the substrate forming the antenna element 63 is adjusted by selecting a material forming the substrate so that the effective specific dielectric constant in the vicinity of the antenna pattern of the antenna element 63 is $\in_1$.

In the above case, as well, with the small area of the circular small radio-wave window 59, the same advantages of the antenna device of the embodiment 4 are provided.

Embodiment 5

(Embodiment Incorporating a Waveguide External to the Container of the Antenna Element)

Embodiment 5 is described below with reference to FIG. 12. FIG. 12 is a perspective view illustrating a portion of the antenna device of the embodiment 5. The antenna device of,the embodiment 5 is identical in structure to the antenna device of the embodiment 4 except that the antenna device of the embodiment 5 includes an external waveguide 68.

Referring to FIG. 12, the antenna device of the embodiment 5 includes the waveguide 68 external to the antenna element container 55 in addition to the antenna device of the embodiment 4.

The external waveguide 68 is arranged outside the antenna element container 55, and contains at the bottom thereof all radio-wave windows 59. The external waveguide 68 is arranged to be in contact with the radio-wave windows 59, and is shaped and dimensioned so that the directivity of the antenna element 63 is enhanced.

To increase the directivity gain of the antenna element during the transmission and reception of the radio wave, the external waveguide 68 is preferably produced by rolling a metal sheet into a cylinder or rolling into a cylinder an insulation film made of polyester with a metal such as silver (Ag), cupper (Cu), gold (Au) or the like deposited thereon.

As shown in FIG. 12, the shape of the external waveguide 68 is shaped so that the opening thereof in contact with the antenna element container 55 is smaller in area than the other opening. The shape of the external waveguide 68 is not necessarily the one shown in FIG. 12. The external waveguide 68 may be shaped into a cylinder having a circular cross section with uniform diameter. Even the external waveguide 68 having such a shape enhances the directivity of the antenna element 63.

To enhance the directivity of the antenna element during the transmission and reception of the radio wave, the height of the external waveguide 68 preferably falls within a range from the wavelength of the transmitted and received radio wave to a quarter of the wavelength of the radio wave.

With the external waveguide 68 arranged external to the antenna container, the antenna device of the embodiment 5 increases the directivity gain of the antenna element during transmission, in addition to the advantages of the antenna device of the embodiment 4. The radio wave, condensed by the radio-wave window 59, is thus intensified when received at the antenna element 63.

Embodiment 6

(Embodiment with a Distance Between a Waveguide and an Antenna Element Being Less than a Quarter of the Wavelength)

Embodiment 6 is described herein with reference to FIG. 13. The antenna device of the embodiment 6 includes the same elements as the antenna device of the embodiment 1 except that a waveguide 74 is shaped and dimensioned to enhance the directivity of the antenna element 72 and that the distance between the waveguide 74 and the antenna element 72 is less than a quarter of the wavelength λ. FIG. 13 is a sectional view of the top portion of the container of the antenna element. Referring to FIG. 13, the antenna element 72 is spaced apart from the waveguide 74 but the distance therebetween is less than a quarter of the wavelength λ. The waveguide 74 is also spaced apart from a shield 71.

Although the end face of the waveguide 74 having the opening is spaced apart from the antenna element 72, the distance therebetween is set to be less than the quarter of the wavelength λ of the transmitted and received radio wave. The reason is described below.

During reception, the received radio wave is confined to within the waveguide 74 from the radio-wave window 73 to the opening of the waveguide 74 opened toward the antenna element 72. Upon exiting from the opening of the waveguide 74, the received radio wave may travel freely in space, and stray. If the distance between the waveguide 74 and the antenna element 72 is large, the radio wave may diverge.

During transmission, the radio wave transmitted from the antenna element 72 may diverge. If the distance between the waveguide 74 and the antenna element 72 is large, the radio wave traveling through the waveguide 74 may weaken, resulting in no increase in directivity gain.

The waveguide 74 is spaced apart from each of the shield 71 and the antenna element 72 in order to block the heat inflow from the waveguide 74 through solid-body heat conduction.

Since the distance between the opening of the waveguide 74 opened toward the antenna element and the antenna element 72 is set to be less than one quarter of the wavelength λ in the antenna device of the embodiment 6, the radio wave having passed through the radio-wave window 73 reaches the antenna element 72 without being diverged even after exiting the waveguide 74 during reception. During transmission, the radio wave transmitted from the antenna element 72 travels through the waveguide 74, and the directivity gain of the antenna element 72 is thus increased.

Since the opening of the waveguide 74 opened toward the antenna element is spaced apart from the antenna element 72, the heat inflow from the waveguide 74 to the antenna element 72 through heat conduction via solid body or gaseous body is controlled. The load on the cooling device cooling the antenna element 72 is reduced. The antenna device of the embodiment 6 also provides the advantages of the antenna device of the embodiment 1, namely, compact design is implemented in the cooling device and thus the entire antenna device.

Embodiment 7

(Embodiment Relating to a Radio-wave Receiver Incorporating an Antenna Device with both a BPF and a Low-Noise Amplifier External to an Antenna Container)

Referring to FIG. 14, a receiver 97 of an embodiment 7 is described herein. The receiver 97 includes an antenna device identical to the antenna device 35 of the embodiment 1. The antenna device of the receiver 97 includes a substrate, antenna elements on the substrate, waveguides, a shield, a discharge O-ring, a vacuum valve, a vacuum pump, a container of the antenna element, a cold plate, a pipe, a cooling medium, and a compressor.

In the container of the antenna element contained in the receiver 97 of the embodiment 7, the positional relationship of the antenna elements, the waveguides, and the radio-wave window in the lid of the container of the antenna element remains unchanged from that of the antenna device of the embodiment 1. The antenna device of the embodiment 7 is identical to the antenna device of the embodiment 1 in that the waveguide thereof is shaped and dimensioned for enhancing directivity.

FIG. 14 illustrates a portion of the receiver 97 including the antenna device. Referring to FIG. 14, there are shown a plurality of antenna elements 80*a*–80*h* in the antenna element container, a substrate 81 for the antenna elements in the antenna element container, a plurality of BPFs (band pass filters) 83–90 arranged external to the antenna element container and respectively connected to the antenna elements 80*a*–80*h*, low-noise amplifiers 91*a*–91*h* respectively connected to the BPFs 83–90 and arranged external to the antenna element container, an IF (interface) 93 external to the antenna element container, and a signal processor circuit 95. The receiver 97 thus includes the BPFs 83–90, the low-noise amplifiers 91*a*–91*h*, each shown in FIG. 13, and the antenna device identical to the antenna device of the embodiment 1.

The BPFs 83–90 are filters for extracting signals of particular frequencies from the signals derived from the radio wave received by the antenna elements. The BPFs 83–90 receives signals from the antenna elements 80*a*–80*h* in the container of the antenna element via cables and RF connectors, and outputs the signals of the particular frequencies to the low-noise amplifiers 91*a*–91*h*.

The low-noise amplifiers 91*a*–91*h* amplify the signals from the BPFs 83–90, and then output the amplified signals to the IF 93.

The IF 93 accurately conducts the signals, received by the receiver 97, to a signal processor circuit 95. The IF 93 also regulates the phases of the signals from the antenna elements 80*a*–80*h*.

The phrase "operatively connecting the antenna elements 80*a*–80h" is defined as "causing the antenna elements

80*a*–80*h* to integrally operate by regulating the phases of the received signals and manipulating a signal from a particular antenna element." The signal processor circuit 95 has a function to cause a plurality of antenna elements as a hybrid antenna by operatively connecting the antenna elements.

The receiver 97 of the embodiment 7 concurrently supplies the received signals from the plurality of antenna elements 80*a*–80*h* to the signal processor circuit 95. By processing appropriately the received signals, the antenna elements 80*a*–80*h* are operatively connected as a hybrid antenna, such as a phased-array antenna or an adaptive array antenna.

Embodiment 8

(Embodiment Relating to a Radio-wave Receiver Incorporating an Antenna Device with Both a BPF and a Low-noise Amplifier Arranged in an Antenna Container)

A receiver 153 of an embodiment 8 is described below with reference to FIGS. 15 and 16.

The antenna device contained in the receiver 153 of the embodiment 8 is identical to the antenna device 35 of the embodiment 1. The antenna device in the receiver 153 includes a substrate, antenna elements on the substrate, waveguides, a shield, a discharge O-ring, a vacuum valve, a vacuum pump, a antenna element container, a cold plate, a pipe, a cooling medium, and a compressor.

In the container of the antenna element contained in the receiver 153 of the embodiment 8, the positional relationship of the antenna elements, the waveguides, and the radio-wave window in the lid of the container of the antenna element remains unchanged from that of the antenna device 35 of the embodiment 1. The antenna device of the embodiment 8 is also identical to the antenna device of the embodiment 1 in that the waveguide is shaped and dimensioned for enhancing directivity.

FIG. 15 illustrates a portion of the receiver 153 of the embodiment 8 containing the antenna device. Referring to FIG. 15, there are shown a plurality of antenna elements 108–111 and 113–116, receiver circuits 100–107 respectively connected to the antenna elements 108–111 and 113–116, the antenna elements 108–111 and 113–116, feeder patterns 122 and 117 for the receiver circuits 100–107, bias-tee patterns 121 and 120 respectively connected to the feeder patterns 112, and 117, a substrate 149 having the above-mentioned circuits, patterns, and elements mounted thereon, and a shield 112. The substrate 149 including the circuit, the patterns, and the elements, and the shield 112 are housed in a container of the antenna elements. The bias-tee patterns 121 and 120 cancel the effect of the feeder patterns 122 and 117 on a radio wave.

FIG. 16 illustrates the receiver 153 of the embodiment 8 and a circuit connected thereto. FIG. 16 is a block diagram of the receiver circuits 100–107 on the substrate 119 of FIG. 15. More specifically, FIG. 16 illustrates the plurality of antenna elements 108–111 and 113–116 the receiver circuits 100–107 respectively connected to the antenna elements and composed of BPFs 133–140 and low-noise receiver circuit 141–148 respectively connected to the BPFs, all these mounted on the same substrate, and an IF 150 and a signal processor circuit 151 not mounted on the same substrate. The antenna device containing the antenna elements 108 . 115 in an antenna element container 152 and the receiver circuits 100 . 107 form the receiver 153 of the embodiment 8.

The IF 150 and the signal processor circuit 151 are arranged external to the antenna element container 152 and not included in the receiver 153 of the embodiment 8. In the same way as described with reference to the embodiment 7, the IF 150 transfers the signals received by the antenna elements 108–115 to the signal processor circuit 151, and the signal processor circuit 151 processes the received signals.

The receiver of the embodiment 8 is different from the receiver of the embodiment 7 in that the antenna elements 108–115 and the receiver circuits 100–107 are arranged in the container of the antenna elements and are cooled together.

In accordance with the embodiment 8 with the above-mentioned difference, the receiver circuits 100–107 and the antenna device are integrated into the receiver 153, thereby miniaturizing the receiver 153. Since the receiver circuits 100–107 are also cooled, performance of the elements of the receiver circuits 100–107 is enhanced. Amplitudes of received signals are increased and filter performance is enhanced.

Embodiment 9

(Embodiment Relating to a Radio-wave Receiver Incorporating an Antenna Device with Antenna Elements, each Antenna Element having a Circular Antenna Pattern, with Both a BPF and a Low-noise Amplifier Arranged in an Antenna Container)

Embodiment 9 is described below with reference to FIGS. 17 and 18.

A receiver 220 of the embodiment 9 includes an antenna device identical to the antenna device 35 of the embodiment 1. The antenna device of the receiver 220 includes a substrate, antenna elements on the substrate, waveguides, a shield, a discharge O-ring, a vacuum valve, a vacuum pump, a container of the antenna element, a cold plate, a pipe, a cooling medium, and a compressor.

In the container of the antenna-element contained in the receiver 220 of the embodiment 9, the positional relationship of the antenna elements, the waveguides, and the radio-wave window in the lid of the container of the antenna element remains unchanged from that of the antenna device 35 of the embodiment 1. The antenna device of the embodiment 9 is also identical to the antenna device 35 of the embodiment 1 in that the waveguide is shaped and dimensioned for enhancing directivity.

FIG. 17 illustrates a portion of the receiver 220 of the embodiment 9 containing the antenna device. Referring to FIG. 17, there are shown a plurality of antenna elements 163–170, feeder points 175–182, receiver circuits 155–162 respectively connected to the antenna elements 163–170, feeder patterns 172 and 174 for the receiver circuits, bias-tee patterns 171 and 173 respectively connected to the feeder patterns 172 and 174, a substrate 175 having the antenna elements 163–170 and the above-mentioned receiver circuits 155–162 mounted thereon, and a shield 176. The antenna elements 163–170, the receiver circuits 155–162, the substrate 175, and the shield 176 are arranged in the container of the antenna elements, and form the receiver 220 of the embodiment 9, together with the antenna device containing the container of the antenna elements.

Each of the antenna elements 163–182 has a circular antenna pattern. Power is fed to the antenna elements 163–182 via the feeder points 175–182 from below the substrate. The feeder points 175–182 are off-centered from the center of the circular antenna patterns of the corresponding antenna-elements with one feeder point in one circular antenna pattern in order to make more pronounced the magnitudes of the received signals and difference in phase between the received signals.

The angle of vibration mode generated in the circular antenna pattern becomes different depending on difference in polarization plane of the circular polarized wave. If the feeder point is off-centered, a time difference to power feeding becomes different depending on the angle of the vibration mode. The difference in the vibration mode results in a difference in phase of the received signals.

The bias-tee patterns 171 and 173 cancel the effect of the feeder patterns 172 and 174 on the radio wave.

FIG. 18 illustrates the substrate 175 of FIG. 17, the plurality of circular antenna elements 163–170 on the substrate 175, the receiver circuits 155–162 respectively corresponding to antenna elements 210–217, and including BPFs 190–197, and low-noise amplifiers 200–207, and an IF 190 and a signal processor circuit 219, both not mounted on the substrate 175.

The antenna elements 210–217 and the receiver circuits 190–197 are arranged in an antenna element container 218. The antenna elements 210–217 and the receiver circuits 190–197, together with the antenna device containing the antenna element container 218, form the receiver 220.

The IF 190 and the signal processor circuit 219 are arranged external to the antenna element container 152, and do not form the receiver of the embodiment 9. The IF 190 transfers the signals received by the antenna elements 163–170 to the signal processor circuit 219 and the signal processor circuit 219 processes the received signals. In this point of view, the IF 190 and the signal processor circuit 219 have the same functions as the IF 150 and the signal processor circuit 151 previously discussed with reference to the embodiment 8. However, the IF 190 and the signal processor circuit 219 are different from the IF 150 and the signal processor circuit 151 in the process method of the received signal that is based on a circular polarized wave as a type of handled radio wave.

The receiver 220 is different from the receiver 153 of the embodiment 8 in that the shape of the antenna pattern of each of the antenna elements 163–170 is circular.

The receiver 220 of the embodiment 9 provides the same advantages as the receivers of the embodiment 7 and the embodiment 8, each incorporating the antenna device of the embodiment 1. With the circular pattern of the antenna elements, if the plurality of antenna elements are operatively connected, the antenna elements 163–170 functioning as a hybrid antenna work on a circular polarized wave.

Embodiment 10

(Embodiment Relating to an Antenna Element for use in an Antenna Device)

Referring to FIGS. 19–23, the shape, material, and structure of the antenna element of an embodiment are described below.

The antenna element made of a superconducting material in accordance with the embodiment is the antenna element used in the antenna devices of the embodiment 1 through the embodiment 6, and referred to as a plane-type antenna having an antenna pattern disposed on a substrate. (In the discussion of the embodiment 10, the plane-type antenna element is simply referred to an "antenna element.") The antenna pattern of an antenna element 233 made of a superconducting material in accordance with the embodiment 10 has a size preferably equal to ½λ or ¼λ as shown in FIG. 18 where λ represents the wavelength of the radio wave to be received. The antenna pattern having a size of ½λ and ¼λ provides good matching between the received radio wave and the antenna pattern. When the radio wave is received, current canceling within the antenna is controlled.

FIG. 19 illustrates a substrate 231 of an antenna element 233 of the embodiment 10, an antenna pattern 230 made of a superconducting material and disposed on the substrate, and a ground conductor 232 made of a superconducting material and disposed on the back side of the substrate. Power feeding is performed between two L-shaped patterns forming the antenna pattern 230.

The antenna pattern 230 is a so-called dipole antenna. The size of the antenna pattern 230 is about half the wavelength. The wavelength has the same definition as the "wavelength" discussed with reference to the embodiment 1.

The antenna element 233 may be composed of a single antenna pattern. Alternatively, an antenna pattern 235 composed of a plurality of T-type linear antenna patterns shown in FIG. 20 may also be acceptable.

The antenna element of the embodiment 10 may be an antenna pattern 240 of FIG. 21 as a different antenna pattern. The antenna pattern 240 is composed of a plurality of patch-type antenna patterns connected. (FIG. 21 is quoted "High-Temperature Superconducting Microwave Circuits" Zhi-Yuan Shen, Artch House Microwave Library P 134–145.)

If the frequency of a radio wave handled herein is 10 GHZ, the wavelength in the vacuum is about 3 cm. If the substrate 231 has a low specific dielectric constant, the size of the substrate 231 of the antenna element of FIG. 18 may be about 2 cm×2 cm. The size of the substrate of FIGS. 20 and 21 is about 12 cm×12 cm, for example.

The superconducting material forming the antenna element of the embodiment 10 may be preferably one of REBCO system (containing a rare earth element, barium (Ba), copper (Cu), and oxygen (O)), a BSCCO system (containing barium (Ba), strontium (Sr), calcium (Ca), copper (Cu), and oxygen (0)), and a PBSCCO system (lead (Pb), barium (Ba), strontium (Sr), calcium (Ca), copper (Cu), and oxygen (O)). The superconducting material needs to be a high-temperature superconducting material and conduct a large current. Under low temperature, the superconducting material provides a low surface resistance, and has tens of milli ohms (Ω) in a millimeter wave range, and provides advantages as a material of the antenna element over copper (Cu). The superconducting materials categorized as the REBCO system includes Ym1Bam2Cum3Om4 ($0.5 \leqq m1 \leqq 1.2$, $1.8 \leqq m2 \leqq 2.2$, $2.5 \leqq m3 \leqq 3.5$, $6.6 \leqq m4 \leqq 7.0$), Ndp1Bap2Cup3Op4 ($0.5 \leqq p1 \leqq 1.2$, $1.8 \leqq p2 \leqq 2.2$, $2.5 \leqq p3 \leqq 3.5$, $6.6 \leqq p4 \leqq 7.0$), Ndq1Yq2Baq3Cuq4Oq5 ($0.0 \leqq q1 \leqq 1.2$, $0.0 \leqq q2 \leqq 1.2$, $0.5 \leqq q1+q2 \leqq 1.2$, $1.8 \leqq q3 \leqq 2.2$, $2.5 \leqq q3 \leqq 3.5$, $6.6 \leqq p4 \leqq 7.0$), Smp1Bap2Cup3Op4 ($0.5 \leqq p1 \leqq 1.2$, $1.8 \leqq p2 \leqq 2.2$, $2.5 \leqq p3 \leqq 3.5$, $6.6 \leqq p4 \leqq 7.0$), and Hop1Bap2Cup3Op4 ($0.5 \leqq p1 \leqq 1.2$, $1.8 \leqq p2 \leqq 2.2$, $2.5 \leqq p3 \leqq 3.5$, $6.6 \leqq p4 \leqq 7.0$). Rare earth elements for use as a superconducting material include Lu, Yb, Tm, Er, Dy, Gd, Eu, La, etc., in addition to the above-mentioned Y, Nd, Sm, and Ho. (Reference is made to the book entitled "Superconducting Material", authored by Kouzou OSAMURA, Yoneda Shuppan).

Unlike standard superconducting materials that require a low temperature as low as that of liquid helium (about 4K) as the critical temperature below which surface resistance sharply drops, the above-mentioned superconducting materials simply work at a temperature as low as liquid nitrogen (about 50 to 70 K). Cooling is easily performed on an antenna element made of the superconducting material to achieve practicable surface resistance. An antenna element made of the REBCO system can transmit and receive radio wave at a lower loss than an antenna element made of copper (Cu).

A superconducting film forming the antenna pattern of the antenna element, made of the superconducting material of the embodiment 10, is preferably constructed of crystal grains having excellent crystal growth performance and a large grain structure (hereinafter referred to as "grains"). Given the same superconducting material, the better the crystal growth and the larger the grain size, the lower the surface resistance of the superconducting film becomes.

Double logarithm chart of FIG. 22 show plots of frequency-dependent surface resistance of typical low-temperature superconducting materials including $Nb_3Sn$, REBCO system, BSCCO system, and Y (yttrium)—Ba—Cu—O representing high-temperature superconducting materials of perovskite-like copper oxide of PBSCCO system. As shown in FIG. 22, the X axis represents frequency while the Y axis represents surface resistance. Blank triangle symbols represent the surface resistance of $Nb_3Sn$, and solid circle symbols represent the surface resistance of epitaxially grown Y-123 . Y-123 is a general expression of Y—Ba—Cu—O, and numerals 123 respectively represent composition ratios of Y, Ba, and Cu. Blank circle symbols represent the surface resistance of polycrystal Y-123 not epitaxially grown. Broken line represents the surface resistance of copper (Cu). (FIG. 22 is quoted from 2M. Hein, High-Temperature-superconductor Thin Film at Microwave Frequencies, Springer, 1999, P 93.) As shown in FIG. 22, epitaxially grown Y-123 having large grains shows a lower surface resistance at low-temperature state.

As shown in FIG. 23, the superconducting film forming the antenna pattern of the antenna element of the embodiment 10 has large grains of several μm diameter in a plane of an a-axis and b-axis observable by a microscope. The grains are preferably c-axis oriented in a direction vertical to the substrate on which the superconducting film is formed. The crystal axes of the grains are preferably regulated. In the above discussion, the a-axis, the b-axis, and the c-axis are the names of the crystal axes. The crystal axes are referred to as the a-axis, the b-axis, and the c-axis in order of the length of crystal grating from short to long.

If a superconducting film composed of c-axis oriented grains is arranged in a direction vertical to the substrate, one of an a-axis plane and a b-axis plane is parallel to the substrate. As a result, currents flow in one of the a-axis plane and the b-axis plane, each of which has a relatively stronger superconducting property, rather than in the c-axis direction known for its relatively weak superconducting property. The surface resistance of the superconducting film becomes low.

It is known that if the directions of the crystal axes of the grains are uniform with adjacent grains regulated in crystal axis direction, the linkage of superconducting currents between grains become stronger and the surface resistance of the film becomes even lower.

FIG. 23 shows an A-B cross section of the antenna pattern of FIG. 19. Referring to FIG. 23, there are shown a substrate 252 having a MgO (100) face as the surface thereof, a superconducting film, a grain 250 of the superconducting film, a direction 251 of the c-axis of the superconducting film, and a direction 253 of the a-axis or b-axis of the superconducting material. The grain of the superconducting film is strongly c-axis oriented in the direction vertical to the MgO (100) face. Because of this, a current from feeder point of the antenna element flows a plane containing one of the a-axis and the b-axis when the antenna element transmits and receives a radio wave.

The thickness of the film forming the antenna pattern preferably falls within a range of about 100 nm to about 1 μm in view of the relationship of patterning and magnetic penetration depth.

The antenna patterns 230, 235, and 240 are produced by patterning, on a MgO substrate 252, a superconducting film having large grains and c-axis oriented in the direction vertical to the MgO (100) face as discussed below.

A substrate having the MgO (100) and a superconducting material composed of the Y—Ba—Cu—O system as a target are arranged with one surface of the substrate facing to the target in a vacuum container. A pulsed laser light beam (for example, KrF laser having a wavelength of 248 nm) is directed to the target. The superconducting material is driven out of the target in a plasma state to be deposited onto the surface of the substrate. The interior of the vacuum container is kept to a depressurized oxygen atmosphere (for example, in an oxygen atmosphere at a depressurized pressure of about 100 mTorr). The substrate is heated to about 700 to 800° C. As a result, a superconducting film is formed on one surface of the substrate.

The substrate and a target of a superconducting material of the Y—Ba—Cu—O system are arranged with the other surface of the substrate facing the target within the vacuum container. The pulsed laser light beam is directed to the target to drive the superconducting material in a plasma state out of the target to be deposited to the back surface of the substrate. The atmosphere in the vacuum container and the state of the substrate remain identical to those used when the superconducting material is deposited onto the one surface of the substrate. As a result, the superconducting film is deposited on the other surface of the substrate.

The superconducting film formed on the one surface of the substrate is coated with a resist. Using the photolithographic technique, the resist is patterned. A wet etching process or a drying etching process such as Ar milling is performed with the patterned resist serving as a mask. The superconducting material is thus patterned. The resist is then peeled off. The antenna patterns 230, 235, and 240 are formed on the one surface of the substrate.

Electrodes are produced on the antenna pattern, forming the antenna element, on the one surface of the substrate, and on the superconducting film serving as a ground potential on the other surface of the substrate. A metal film, made of gold (Au), silver (Ag), palladium (Pd), titanium (Ti), or the like is formed on both surfaces of the substrate using EB (electron beam) deposition.

The metal film thus formed is patterned using the photolithographic technique and dry etching technique. The electrodes are thus formed on predetermined positions of the antenna elements.

In a process in which the laser light beam deposits the superconducting material onto the substrate while the substrate is being heated in the depressurized oxygen atmosphere, the superconducting film has a large c-axis oriented gain and an adjacent large c-axis oriented grain with one of the a-axis and the b-axis aligned. A linear antenna pattern is preferably formed along one of the a-axis and the b-axis. This is because the crystal axes of the grains become uniform, thereby resulting in a low surface resistance.

In the L-shaped antenna pattern of FIG. 19, the vertical segment of the L-shaped pattern is preferably aligned with the a-axis direction while the horizontal segment of the L-shaped pattern is aligned with the b-axis direction. In the rectangular loop-type pattern of FIG. 21, the long side of the rectangular pattern is aligned with the a-axis direction while the short side of the rectangular pattern is aligned with the b-axis. The above state is thus achieved.

In the antenna element made of the superconducting material of the embodiment 10, the surface resistance is not only lower than in an ordinary metal such as copper (Cu), but also lower than in an antenna element in which high-temperature superconducting materials are simply laminated on a substrate. If the antenna element made of the superconducting material of the embodiment 10 is applied in the embodiment 1 through embodiment 6, excellent antenna characteristics are achieved on radio waves having high-frequency components. Since the high-temperature superconducting material does not require a temperature level so low as that of the standard superconducting material, the cooling device can easily cool the antenna element.

Embodiment 11

(Embodiment Relating to a BPF Element for use in a Radio-wave Receiver or a Radio-wave Transmitter)

FIG. 24 illustrates a BPF element 258 of an embodiment 11.

The BPF element 258 of the embodiment 11 is used in the receiver circuit of the receiver that is used, in each of the embodiment 8 and the embodiment 9, together with the antenna device of each of the embodiment 1 through the embodiment 6. The BPF element 258 is mounted on the same substrate as the antenna element of the antenna device of each of the embodiment 1 through the embodiment 6.

Since the BPF element 258 of the embodiment 11 is mounted on the same substrate as the antenna element, and cooled by the cold plate, the BPF element 258 is preferably made of the same superconducting material as the antenna element of the embodiment 10. This is because the BPF element 258 is at the same low-temperature state as the antenna element and provides a low surface resistance.

FIG. 24 illustrates a BPF pattern 255 of the BPF element 258 made of the superconducting material, a substrate 256, and a ground conductor 257. The substrate of the BPF element has a size of several tens of mm by several tens of mm. Four patterns are formed on the substrate, each pattern including two spiral traces. The number of patterns, each having two spiral traces, typically falls within a range from several to dozens. The number of patterns is usually increased to narrow passband. (FIG. 24 is quoted from FIG. 4 in the specification of the Japanese patent application No. 2002-999997 (filed Mar. 5, 2002, applicant: Fujitsu, Inventors: Manabu KAI, Kazunori YAMANAKA, and others), and FIG. 2, the paper entitled "Development of Superconducting Filter System for IMT-2000", authored by Kai et. al., 2002 Electronics Society Conference, Proceeding SC5-3, the Institute of Electronics, Information and Communication Engineers.

The receiver circuit preferably includes the BPF element 258 made of a superconducting material and an HEMT (High Electron Mobility Transistor) element that operates at low temperature. Because the HEMT element with its configuration and structure selected (such as PHEMT (Pseudomorphic-HEMT)) can operate at a low-temperature. At a low temperature as low as several tens of K, the effect of lattice vibration of the crystal forming the element becomes smaller. The BPF element 258 can operate at low-noise mode. The antenna element, the BPF element 258, and the low-noise amplifier are mounted on the same substrate, and the receiver can thus conduct an amplified signal, namely, a larger signal.

When the BPF element 258 of the embodiment 11 is used in the receiver of each of the embodiment 8 and the embodiment 9, a signal having a predetermined frequency can be extracted from a signal received by the antenna element with low loss involved because of a low surface resistance of the BPF element 258. The receiver of each of the embodiment 8 and the embodiment 9 can output a larger signal to the outside.

Embodiment 12

(Embodiment Relating to a Radio-wave Receiver Employing an Antenna Device with a BPF and an Amplifier Arranged External to a Container)

A transmitter 305 of an embodiment 12 is described below with reference to FIG. 25.

The antenna device contained in the transmitter of the embodiment 12 includes an antenna device identical to the antenna device of the embodiment 1. The antenna device of the transmitter of the embodiment 12 includes a substrate, antenna elements on the substrate, waveguides, a shield, a discharge O-ring, a vacuum valve, a vacuum pump, a container of the antenna elements, a cold plate, a pipe, and a compressor.

In the container of the antenna element contained in the receiver of the embodiment 7, the positional relationship of the antenna elements, the waveguides, and the radio-wave window in the lid of the container of the antenna element remains unchanged from that of the antenna device of the embodiment 1. The antenna device of the embodiment 12 is also identical to the antenna device of the embodiment 1 in that the waveguide is shaped and dimensioned for enhancing directivity.

FIG. 25 illustrates a portion of the transmitter 305 containing an antenna device. Referring to FIG. 25, there are shown a substrate 270 in a container 303 of antenna elements, a plurality of antenna elements 260–267 in the antenna element container 303, BPFs 280–287 respectively connected to the antenna elements 260–267 and arranged external to the antenna element container 303, amplifiers 271–278 respectively connected to the BPFs 280–287 and arranged external to the antenna element container 303, mixers 290–297 respectively connected to the amplifiers 271–278, and arranged external to the antenna element container 303, a frequency multiplier 301 connected to the mixers 290–297 and arranged external to the antenna element container 303, an oscillator 301 connected to the frequency multiplier 301 and arranged external to the antenna element container 303, and IF 300 connected to the mixers 290–297 and arranged external to the antenna element container 303. As shown in FIG. 25, the amplifiers 271–278, and the BPFs 280–287 form, together with the antenna device containing the antenna elements 260–267 in the antenna element container 303, a transmitter 304.

The IF 300 modulates a signal from an apparatus that represents information into a signal to be transmitted. The oscillator 302 and the frequency multiplier 301 generate a carrier wave. The mixers 290–297 mixes the carrier wave and a modulation signal for up conversion, namely, modulates the carrier wave. The BPFs 280–287 attenuate wanted signals other than a transmission wave, and the amplifiers 271–278 amplify the signal to be transmitted from the antenna.

If the antenna elements of the embodiment are used in the transmitter of the embodiment 12, a radio wave is transmitted at low loss because the surface resistance of the antenna elements is low.

In the transmitter of the embodiment 12, the antenna elements 260–267 for transmission are arranged in the antenna element container 303, and the surface resistance is lowered when the antenna elements 260–267 are cooled. The radio wave is thus transmitted at low loss. A large amplitude signal is thus transmitted with low power consumed.

Embodiment 13

(Embodiment Relating to a Radio-wave Receiver Employing an Antenna Device with BPFs and Amplifiers Arranged in a Container)

A transmitter 350 of an embodiment 13 is described below.

An antenna device contained in the embodiment 13 is identical to the antenna device of the embodiment 1 in that the antenna device includes a container for antenna elements, antenna elements on a substrate, waveguides, a cooling device, and a vacuum pump.

In the container of the antenna element contained in the receiver of the embodiment, the positional relationship of the antenna elements, the waveguides, and the radio-wave window in the lid of the container of the antenna element remains unchanged from that of the antenna device of the, embodiment 1. The antenna device of the embodiment 13 is identical to the antenna device of the embodiment 1 in that the waveguide is shaped and dimensioned for enhancing directivity.

FIG. 26 illustrates a portion of the transmitter 350 containing the antenna device. Referring to FIG. 26, there are shown a plurality of antenna elements 307*a*–307*h* in the antenna element container 347, a substrate 346 for the antenna elements in the antenna element container 347, BPFs 318–325 arranged in the antenna element container 347 and respectively connected to the antenna elements 307*a*–307*h* on the substrate 346, amplifiers 310–317 arranged in the antenna element container and respectively connected the BPFs 318–325 on the substrate, mixers 330–337 arranged external to the antenna element container 347 and respectively connected to the amplifiers 310–317, IF 345 arranged external to the antenna element container 347 and connected to the mixers 330–337, a frequency multiplier 341, and an oscillator 341. The elements shown in FIG. 26 form, together with the antenna device containing the antenna elements 307*a*–307*h* in the antenna element container 347, the transmitter 350.

The IF 345 is a circuit for modulating a signal from an apparatus that represents information into a signal to be transmitted. The oscillator 340 and the frequency multiplier 341 generate a carrier, and the mixers 330–337 mix the carrier and a modulation signal for up conversion, namely, converts the modulation signal to a high-frequency signal. The BPFs 318–325 attenuate unwanted signals other than a transmission signal, and the amplifiers 310–317 amplify a signal to be transmitted from the antenna. The above discussion remains unchanged from the discussion of the embodiment 12.

The antenna element 233 of the embodiment and the BPF element 258 of the embodiment 11 can be incorporated into the transmitter 350 of the embodiment 13. As a result, radio wave can be transmitted with low loss involved because the antenna element 233 and the BPF element 258 provide low surface resistances.

In the transmitter 350 of the embodiment 13, the antenna elements 307*a*–307*h* for transmission and the transmitter circuit are arranged in the antenna element container 347 and are cooled. The surface resistances of these elements are lowered, and transmission is performed with low loss involved. A large amplitude signal can be transmitted with low power consumed. The transmitter of the embodiment 13 is identical to the transmitter of the embodiment 12, but performance of both the antenna elements for transmission and the transmitter circuit is increased. The advantages of transmission at low loss and increase in signal amplitude are even more enhanced.

Since the transmitter circuit is integrated with the antenna device, the transmitter 350 of the embodiment 13 can be miniaturized.

INDUSTRIAL APPLICABILITY

In accordance with the present invention, a high directivity gain antenna device is provided using an antenna element made of a superconducting material. An antenna device, a radio-wave transmitter employing the antenna device, and a radio-wave receiver employing the antenna device are operable at low loss. In accordance with the present invention, the antenna device, the radio-wave receiver, and the radio-wave transmitter, each employing an antenna element made of a plurality of superconducting materials, are miniaturized. In accordance with the present invention, a cooling system of the antenna device, the radio-wave receiver, and the radio-wave transmitter, each employing an antenna element made of a superconducting material consumes low power.

REFERENCE NUMERALS

Figure 1:
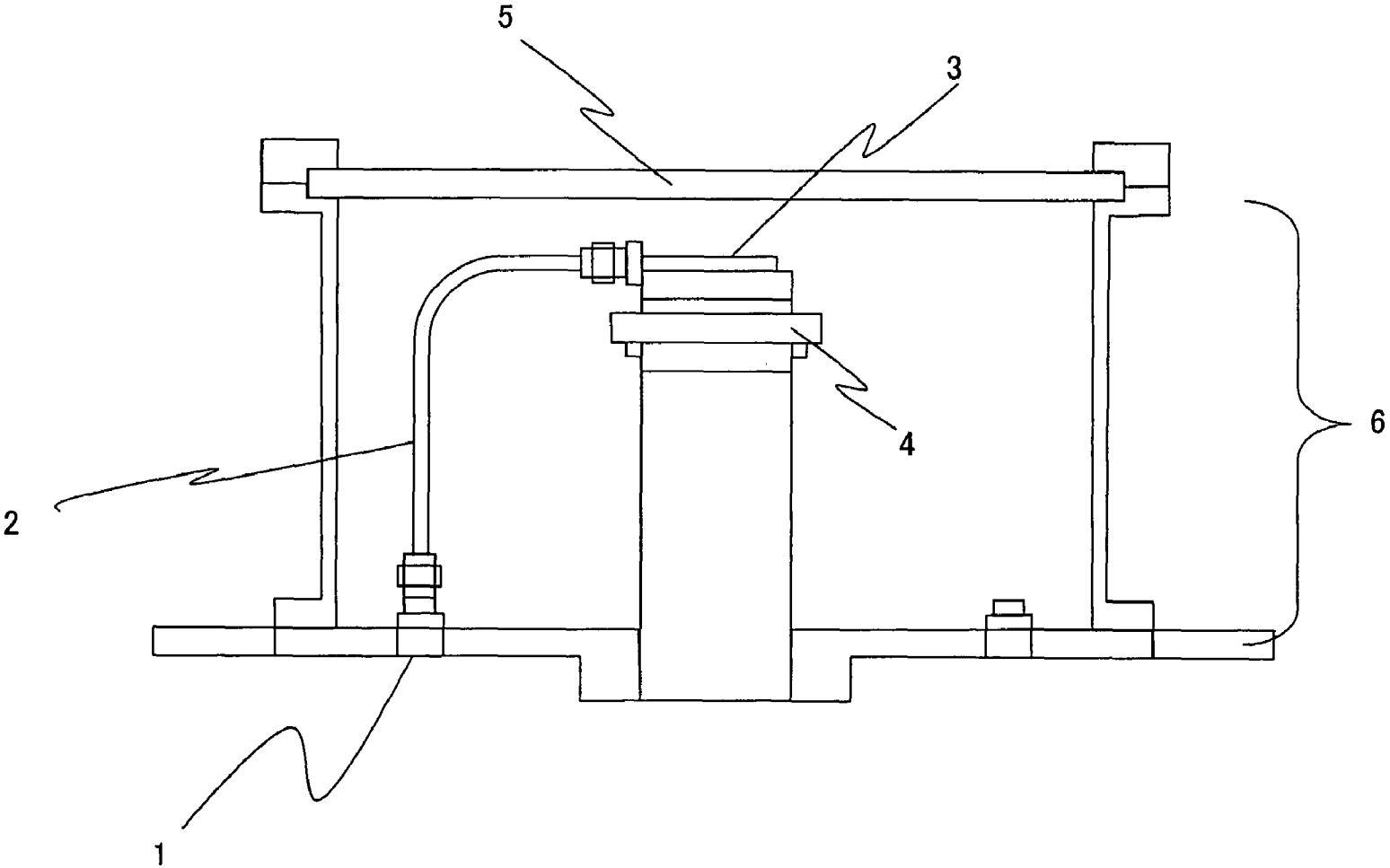
FIG. 1 diagrammatically illustrates an antenna device of a known example 1.
Figure 2:
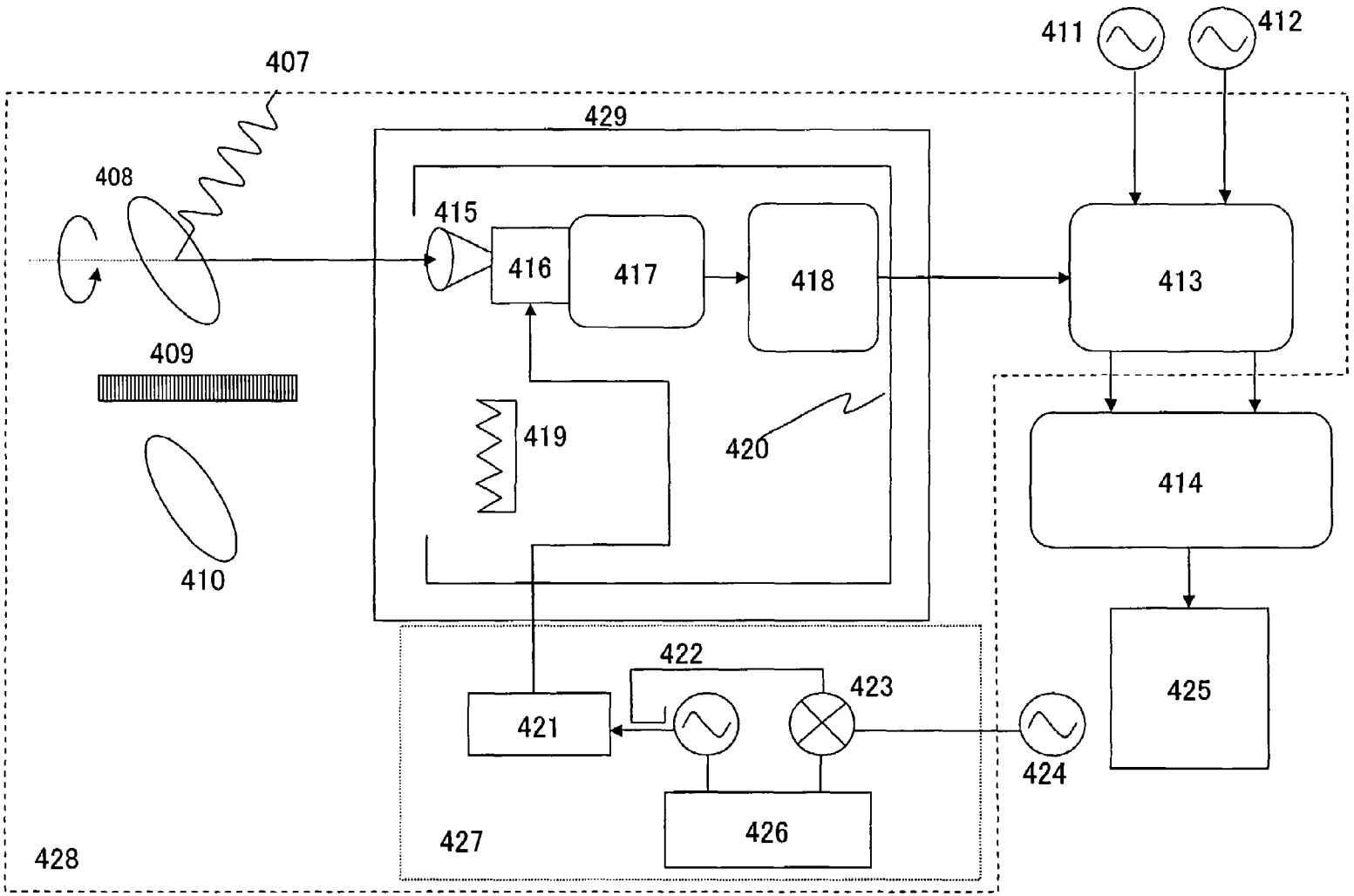
FIG. 2 diagrammatically illustrates a stratosphere-mesosphere ozone monitoring system of a known example 2.
Figure 3:
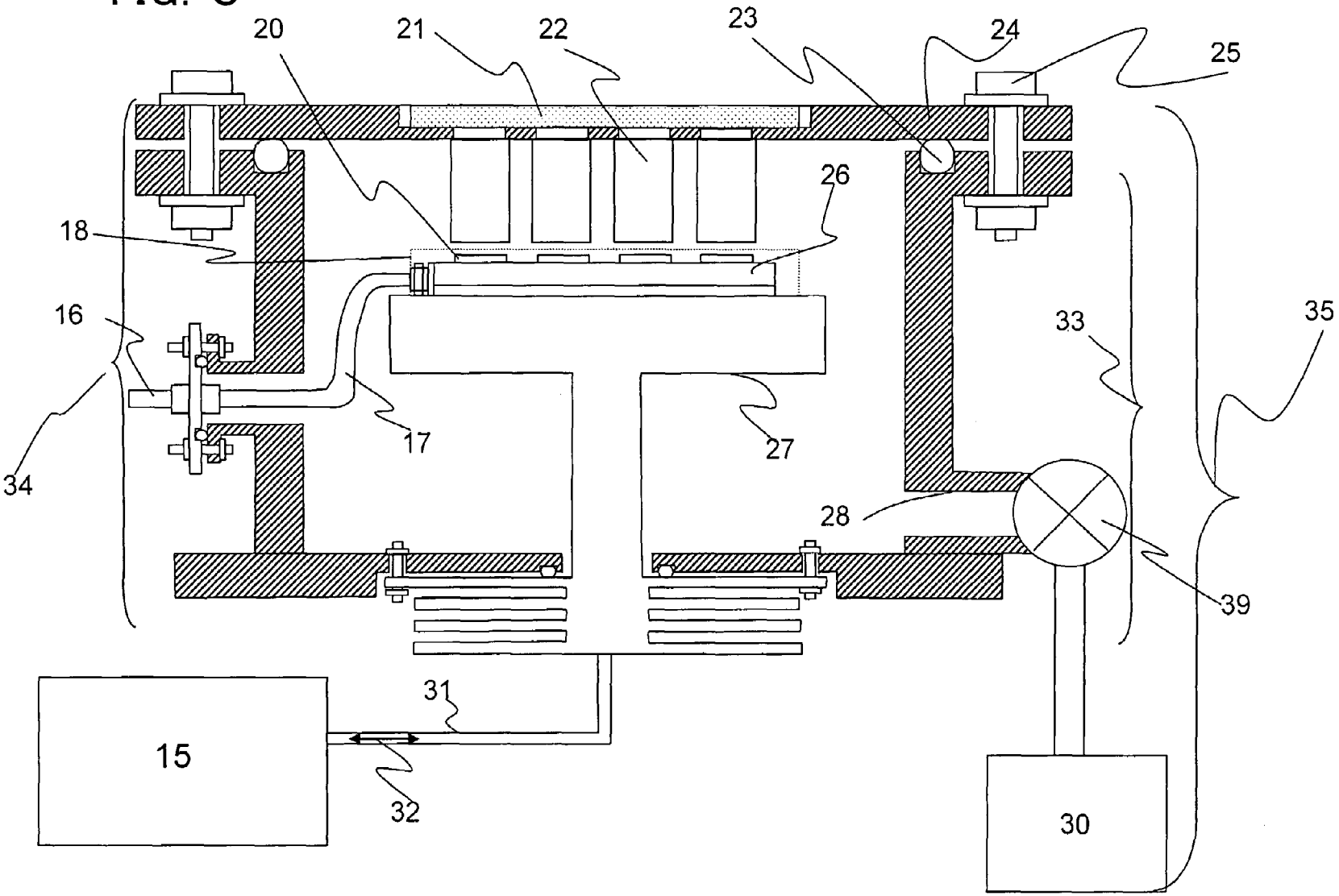
FIG. 3 diagrammatically illustrates a first embodiment.
Figure 4:
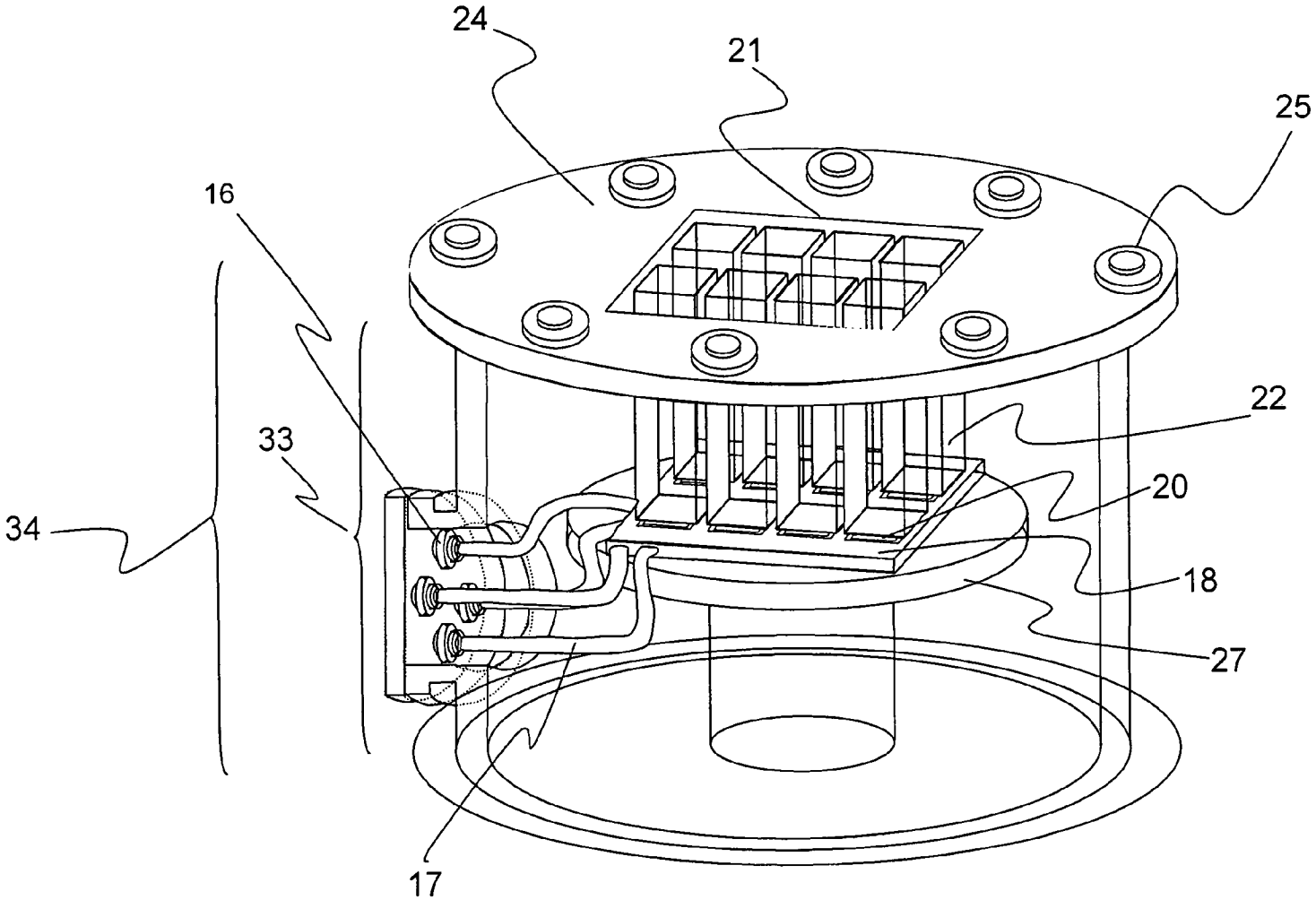
FIG. 4 is a perspective view of an antenna element container of the first embodiment.
Figure 5:
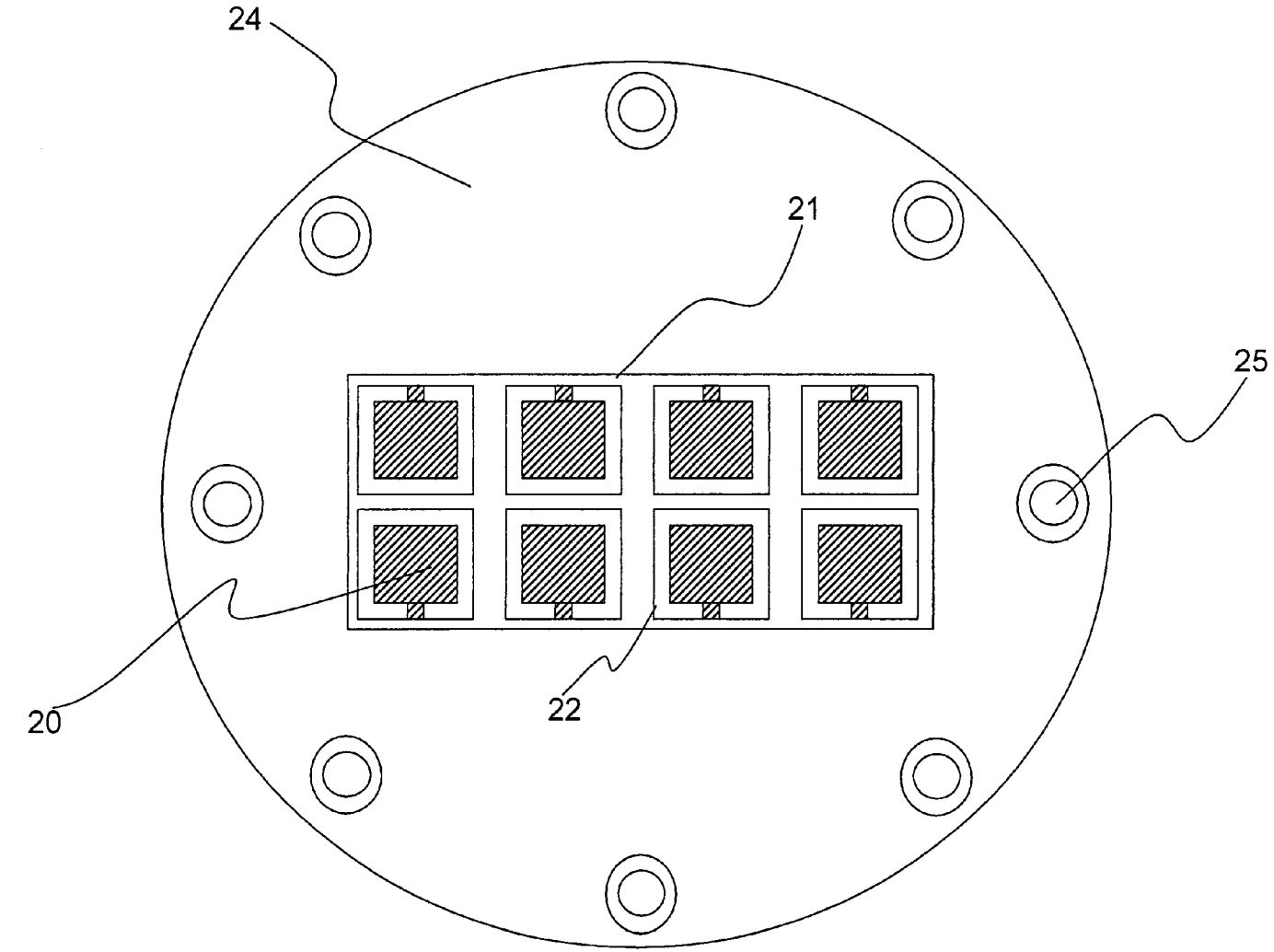
FIG. 5 is a top view of the antenna element container of the first embodiment.
Figure 6:
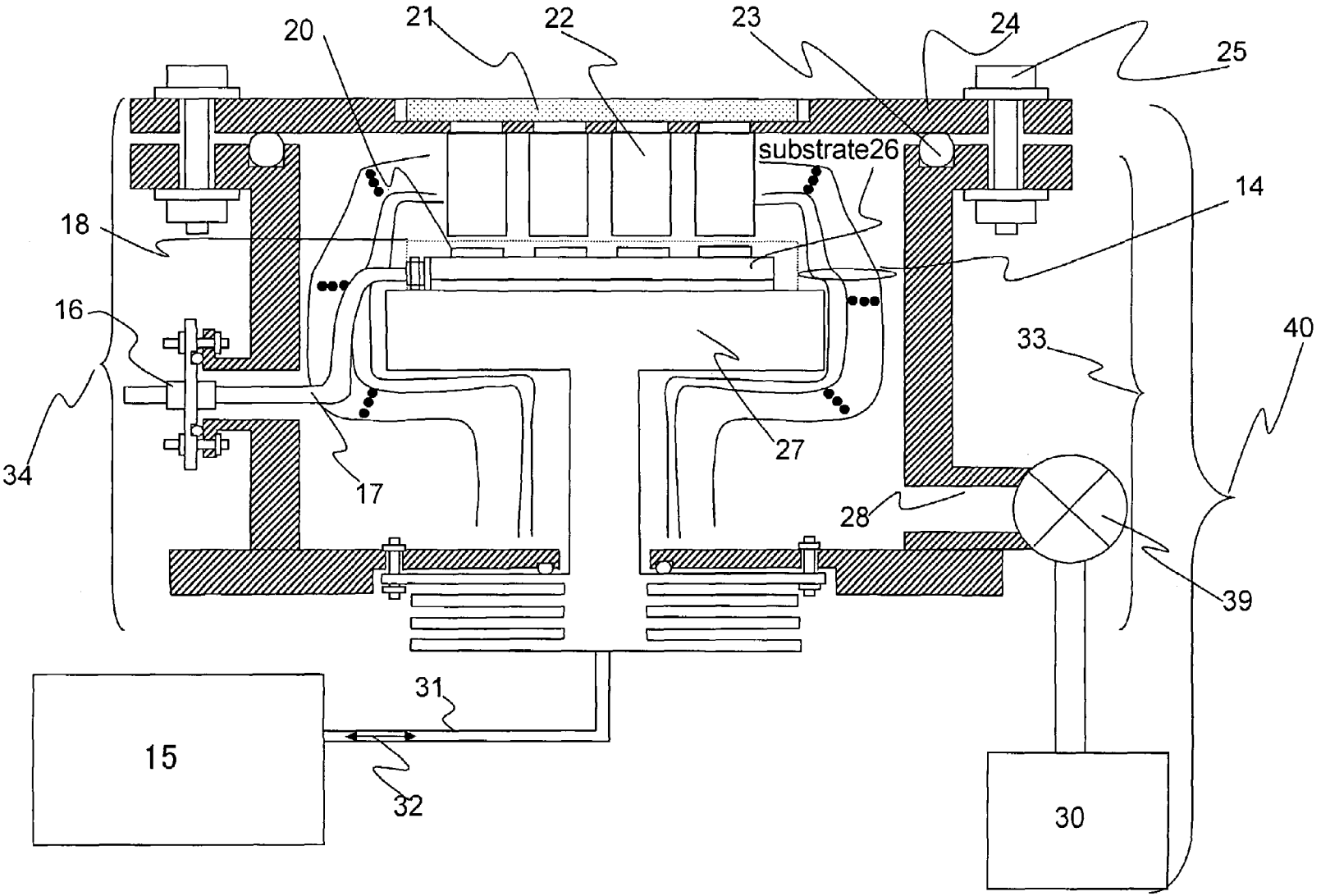
FIG. 6 diagrammatically illustrates a second embodiment.
Figure 7:
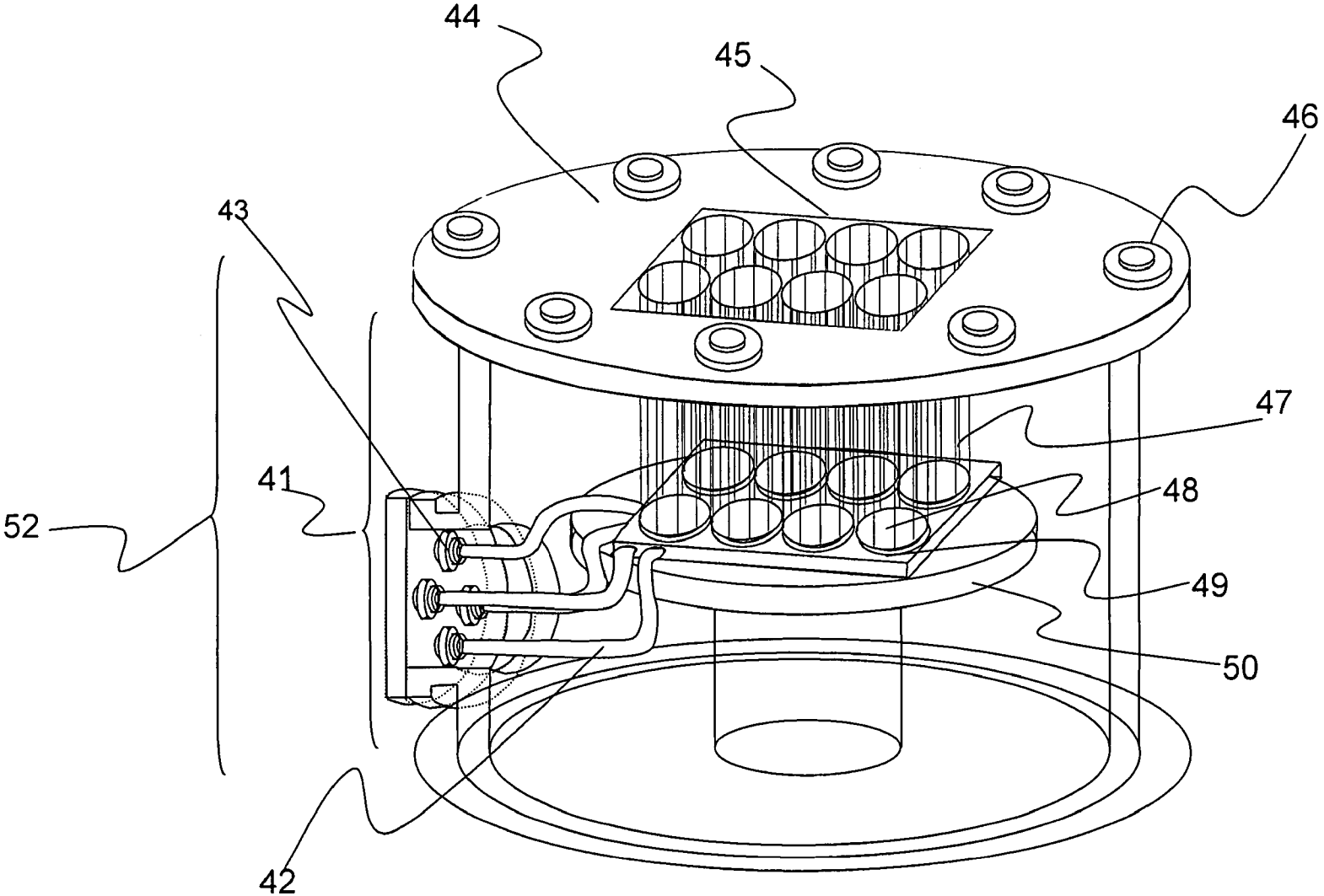
FIG. 7 is a perspective view of an antenna element container of a third embodiment.
Figure 8:
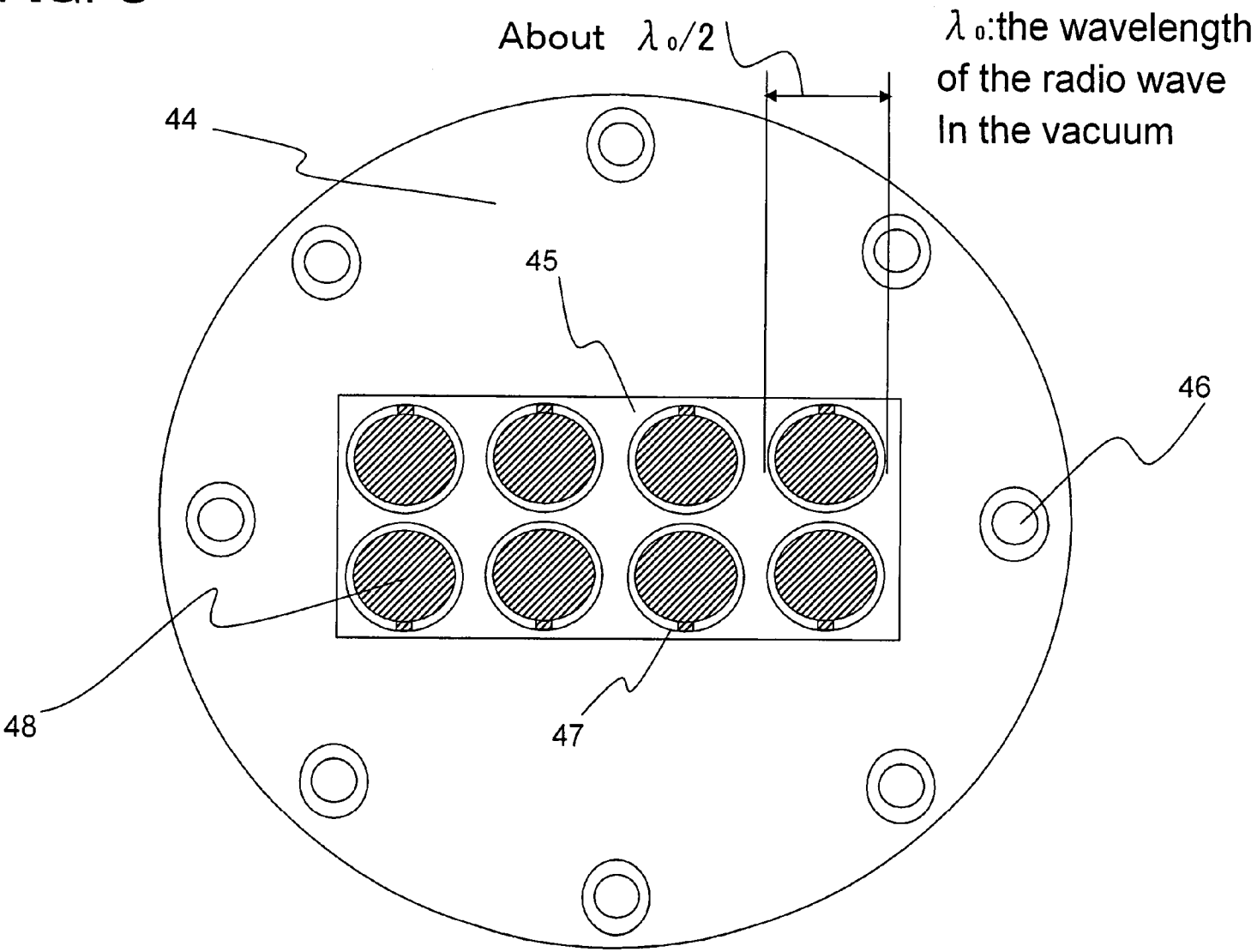
FIG. 8 is a top view of an antenna element container of the third embodiment.
Figure 9:
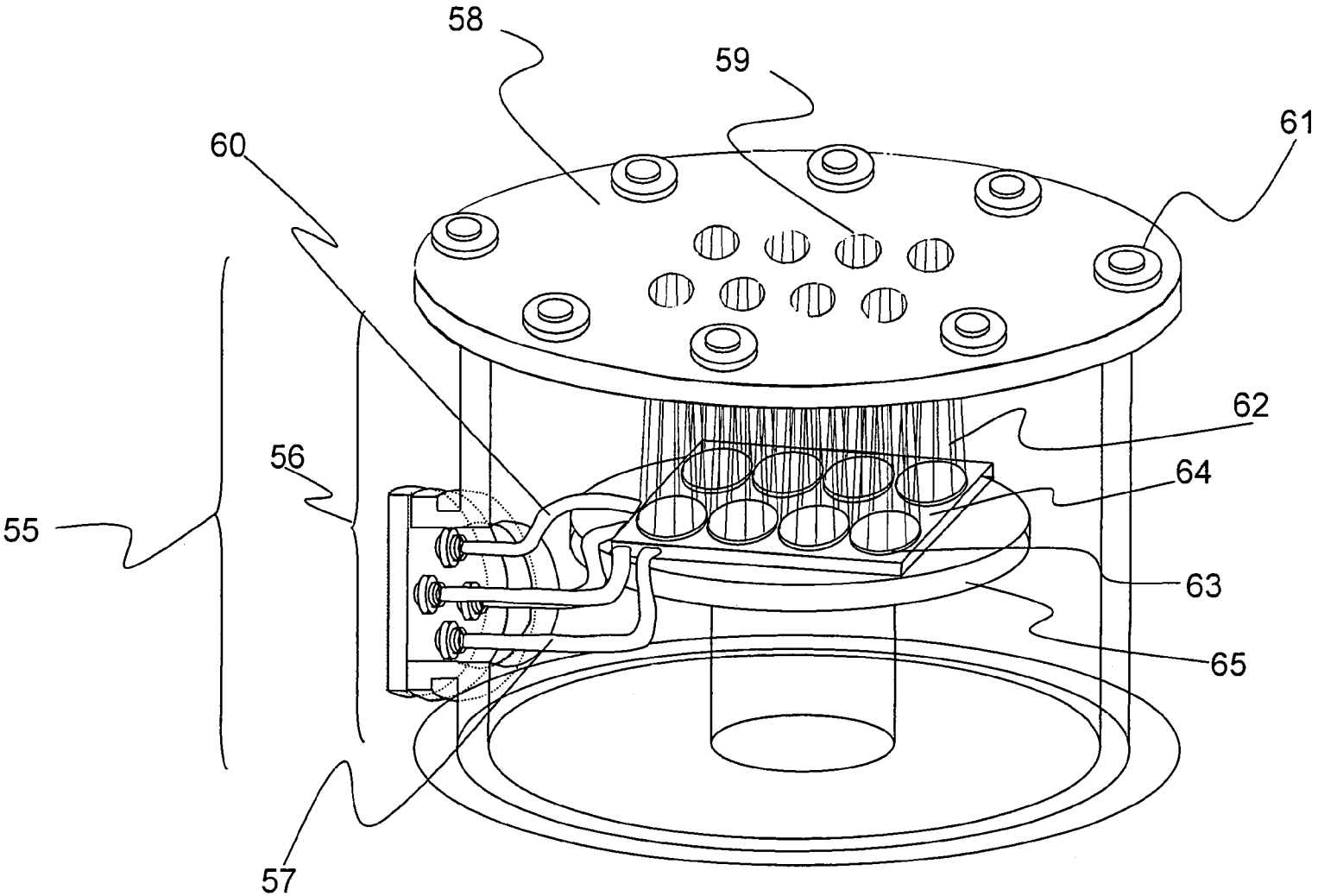
FIG. 9 is a perspective view of an antenna element container of a fourth embodiment.
Figure 10:
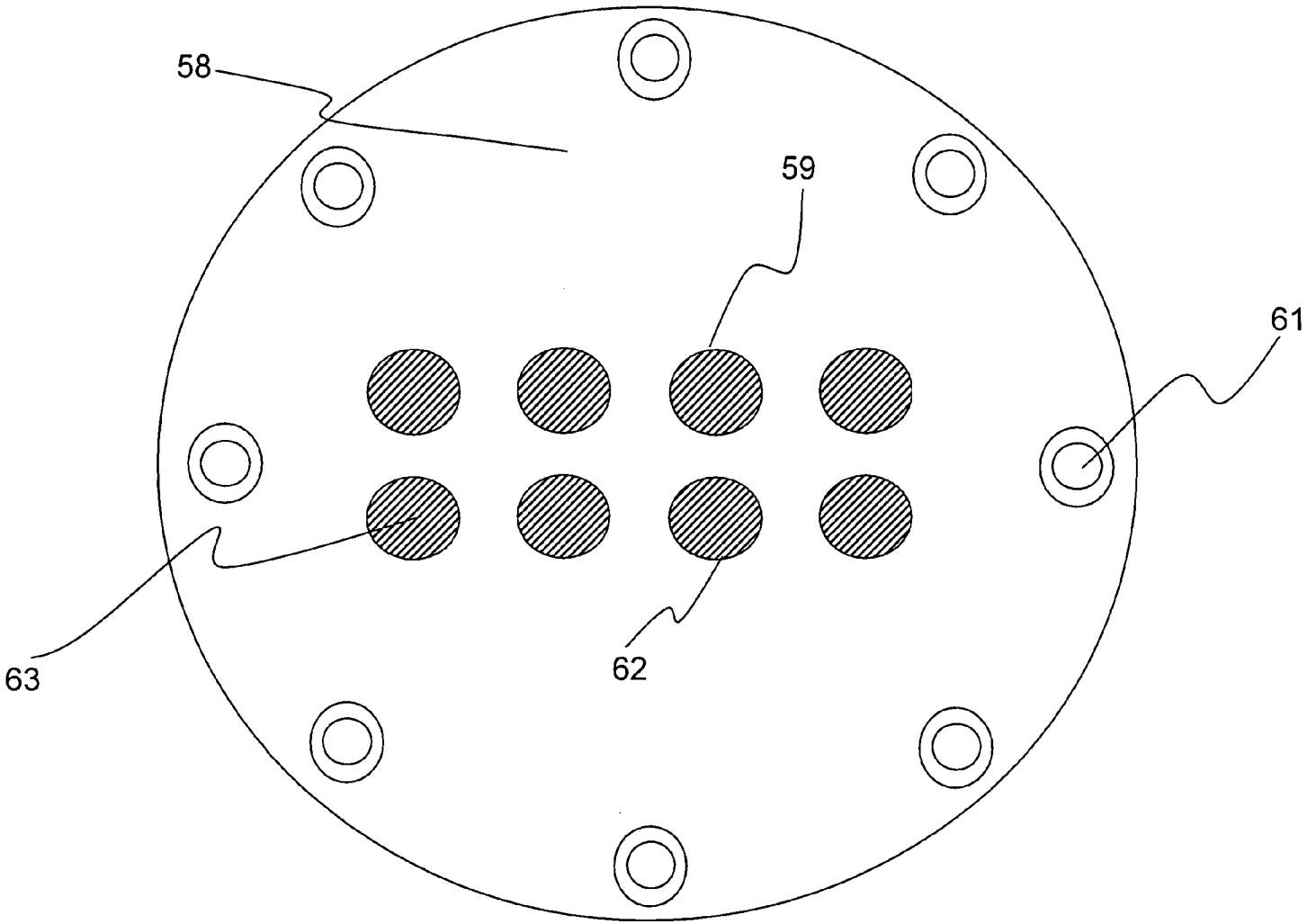
FIG. 10 is a top view of the antenna element container of the fourth embodiment.
Figure 11:
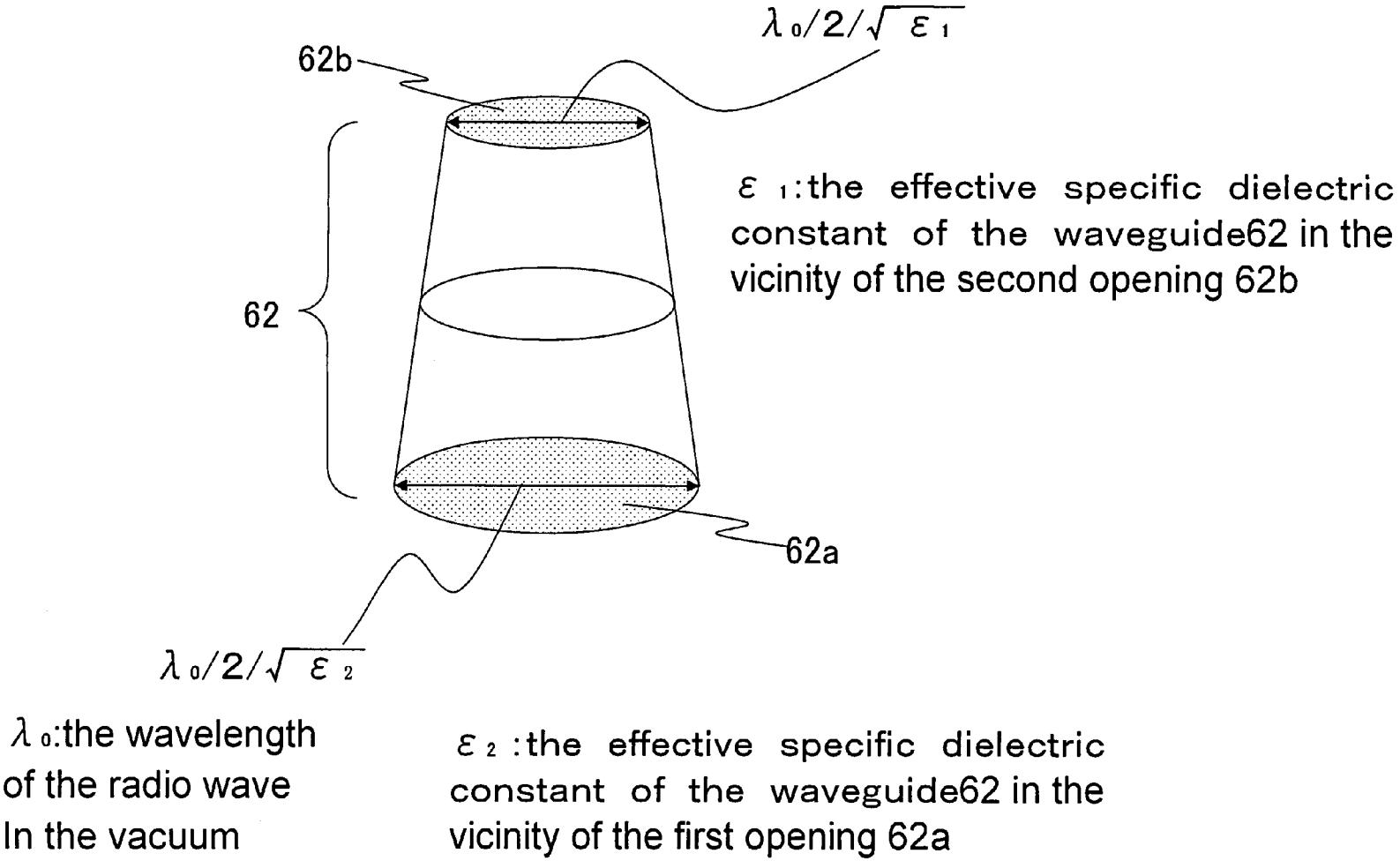
FIG. 11 is a perspective view of a waveguide of the fourth embodiment.
Figure 12:
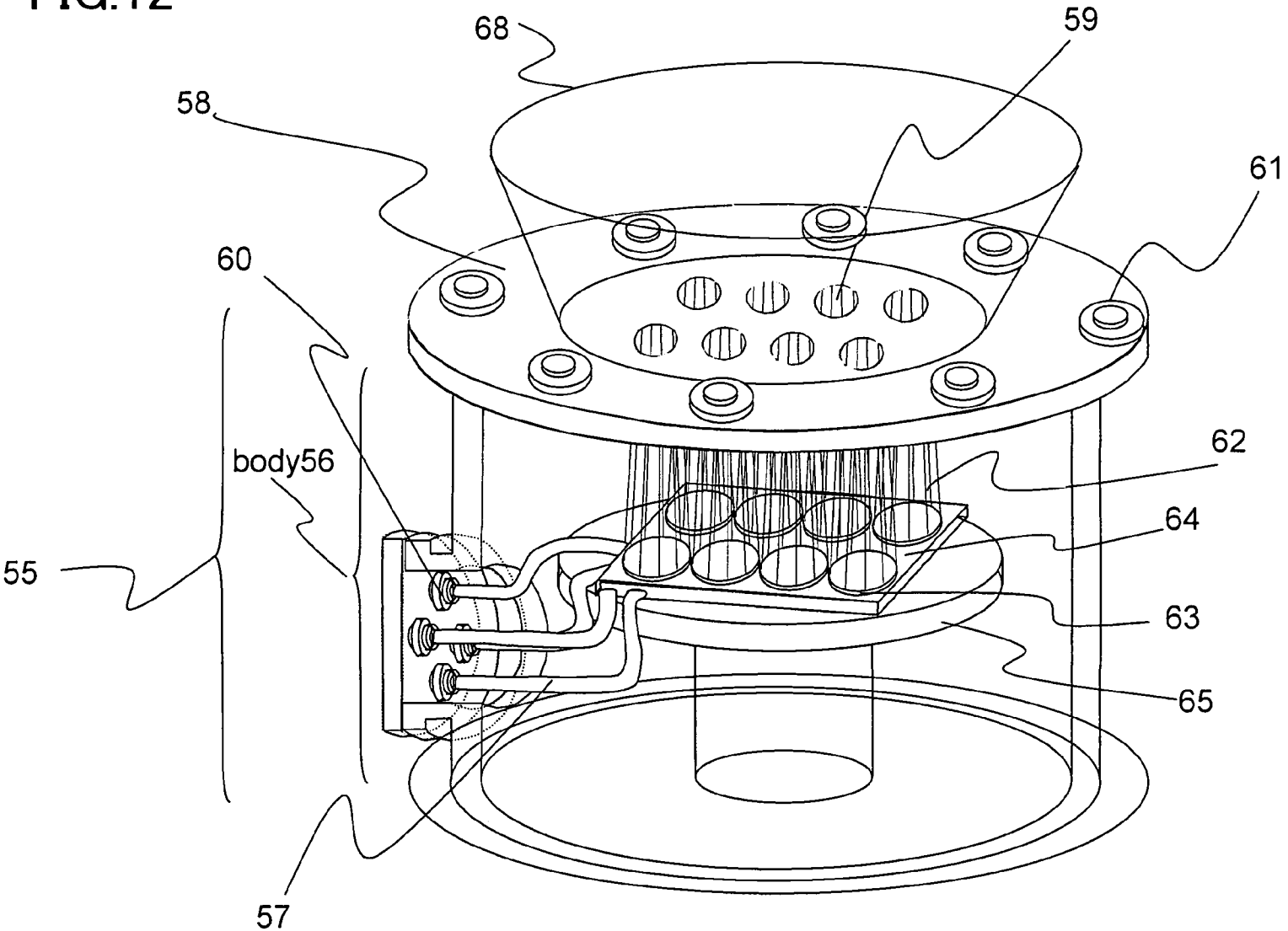
FIG. 12 is a perspective view of an antenna element container of a fifth embodiment.
Figure 13:
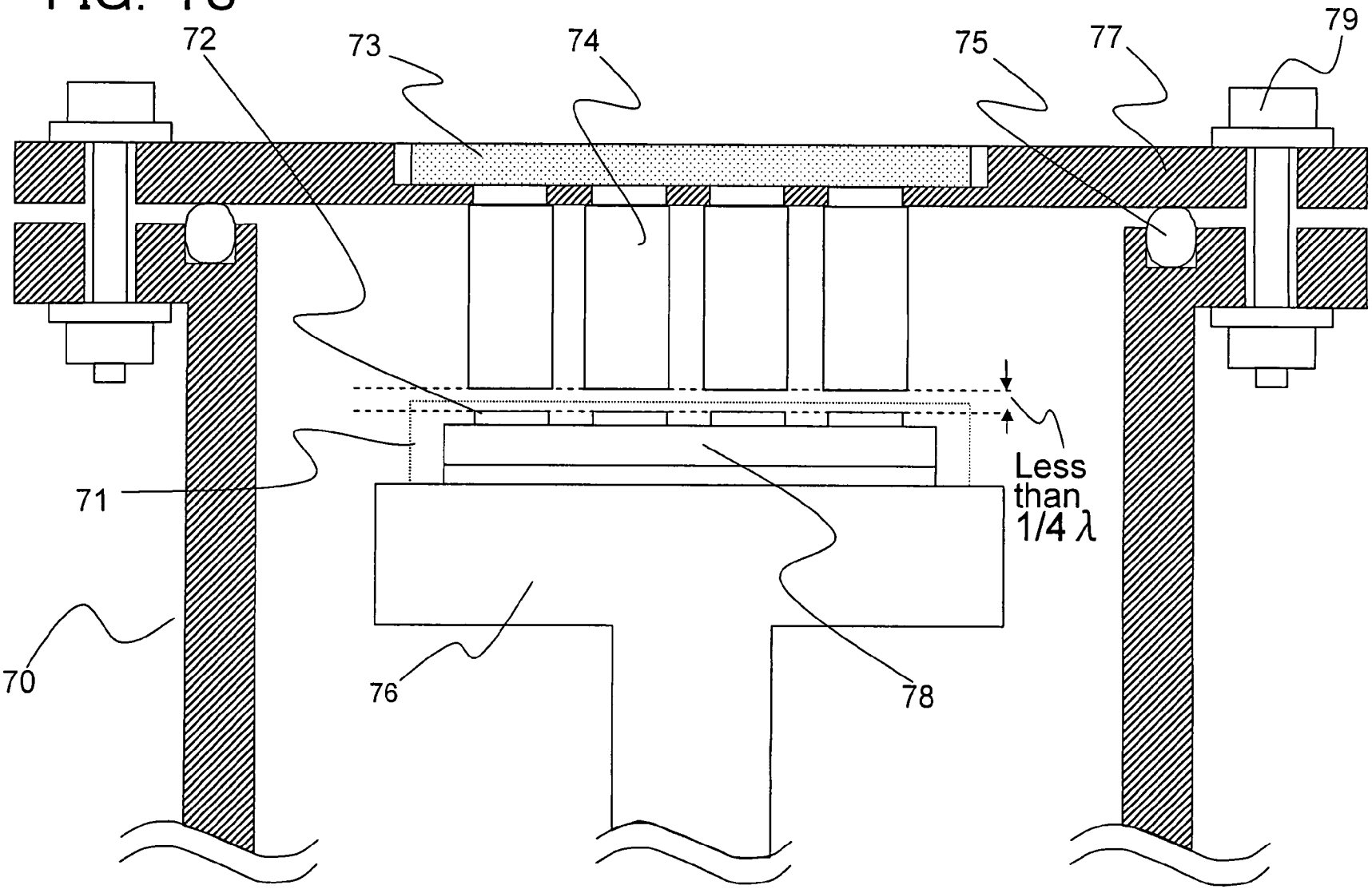
FIG. 13 is a sectional view of a sixth embodiment.
Figure 14:
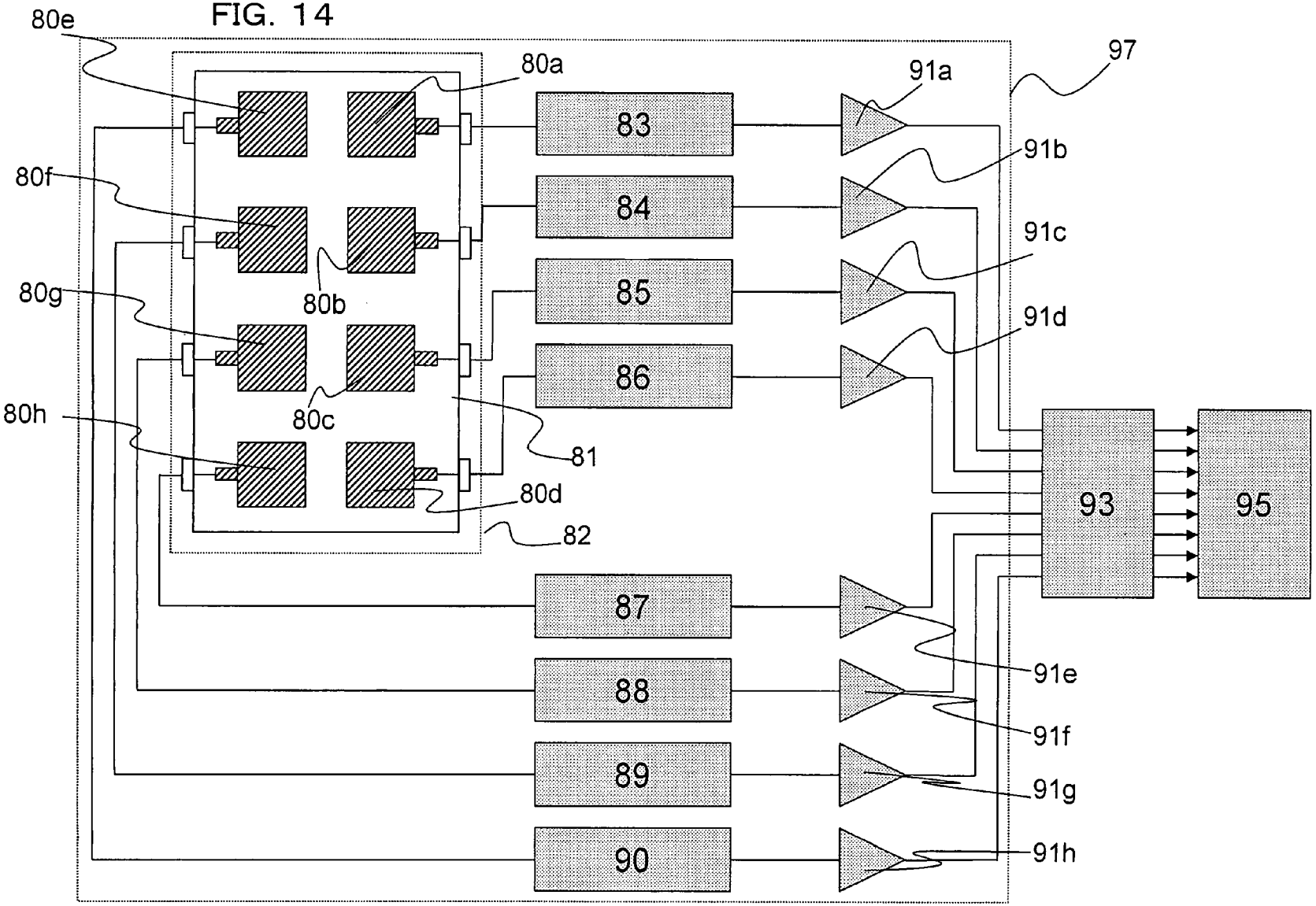
FIG. 14 is a block diagram illustrating a receiver of a seventh embodiment.
Figure 15:
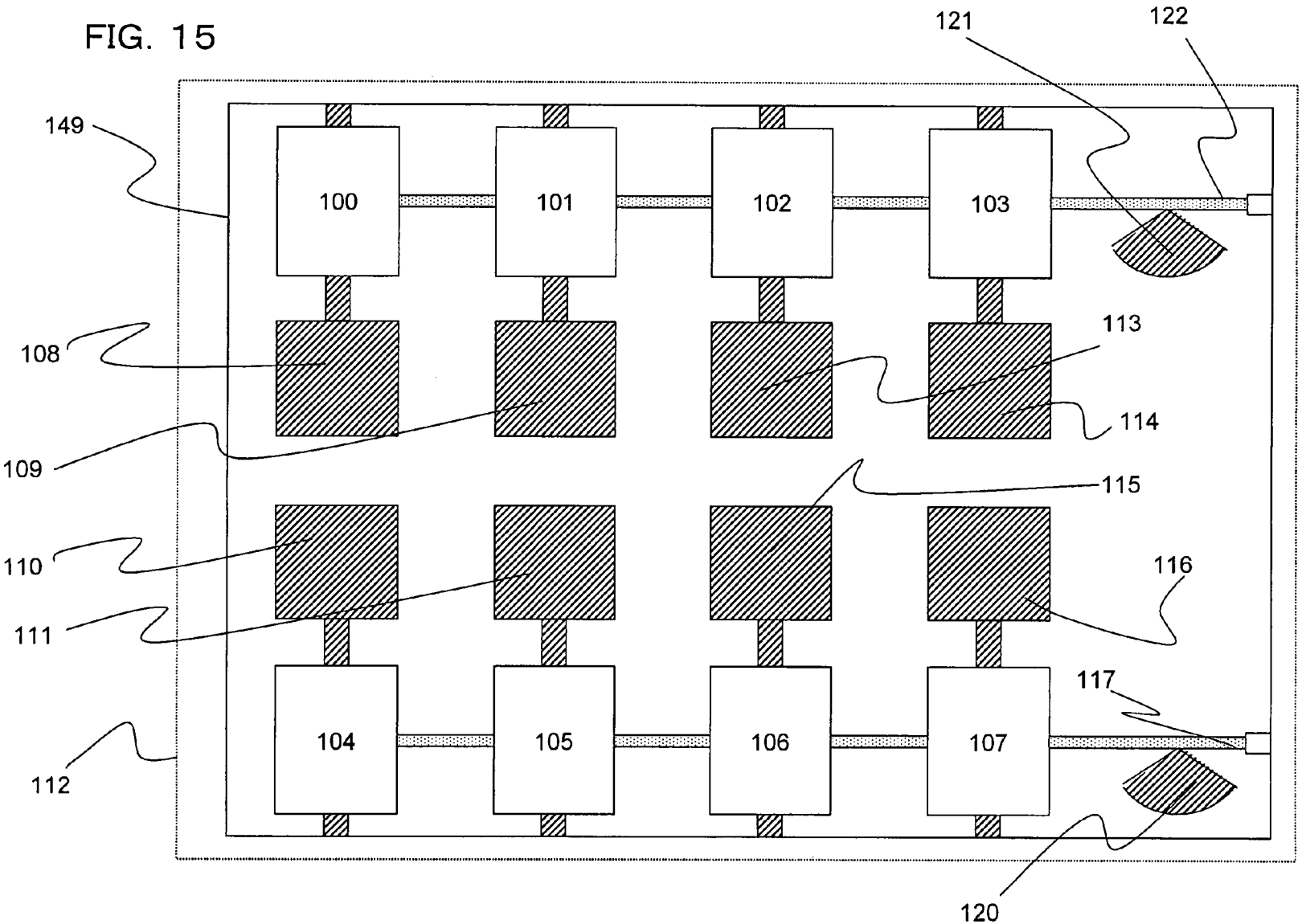
FIG. 15 diagrammatically illustrates a substrate of an eighth embodiment.
Figure 16:
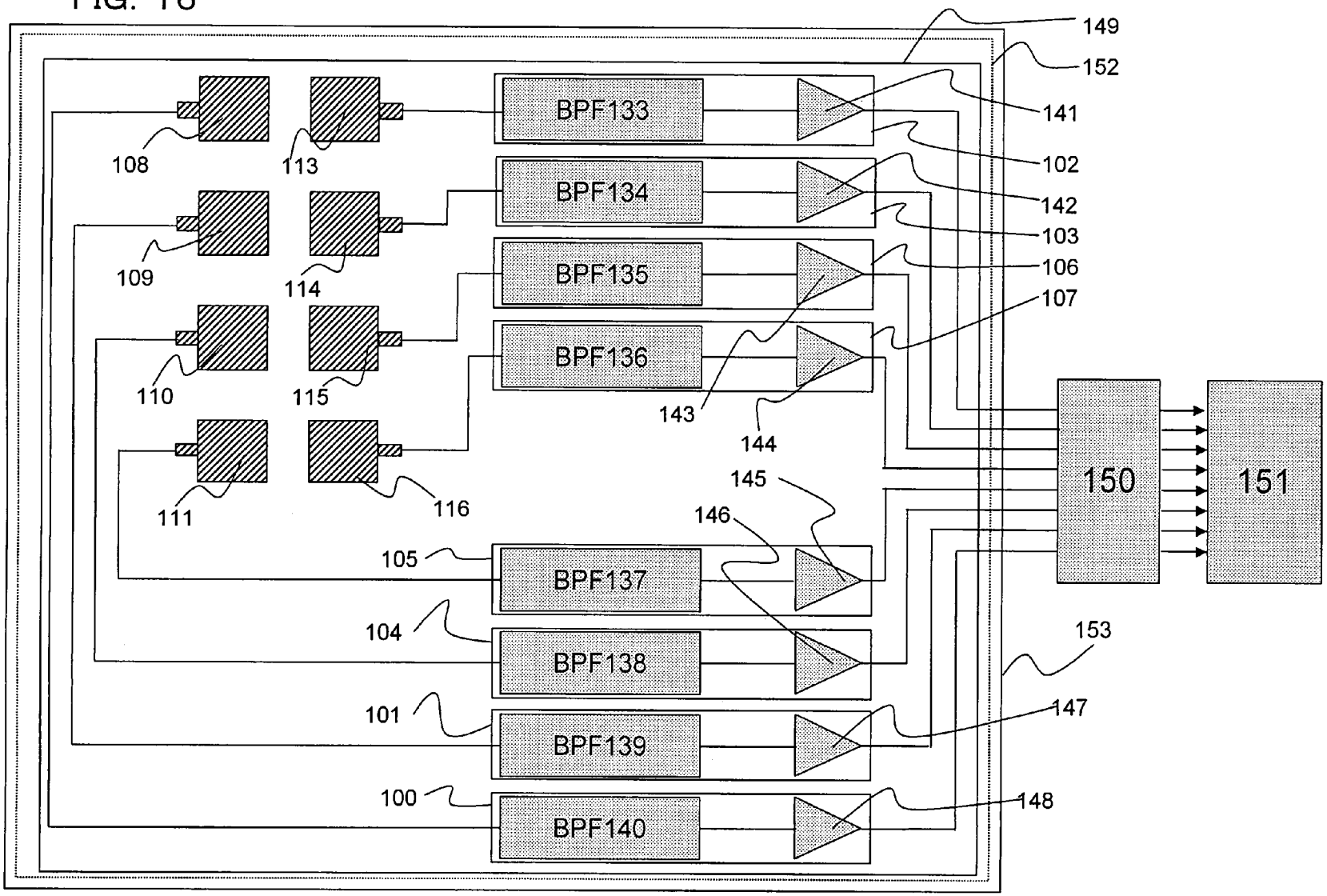
FIG. 16 is a block diagram illustrating a receiver of the eighth embodiment.
Figure 17:
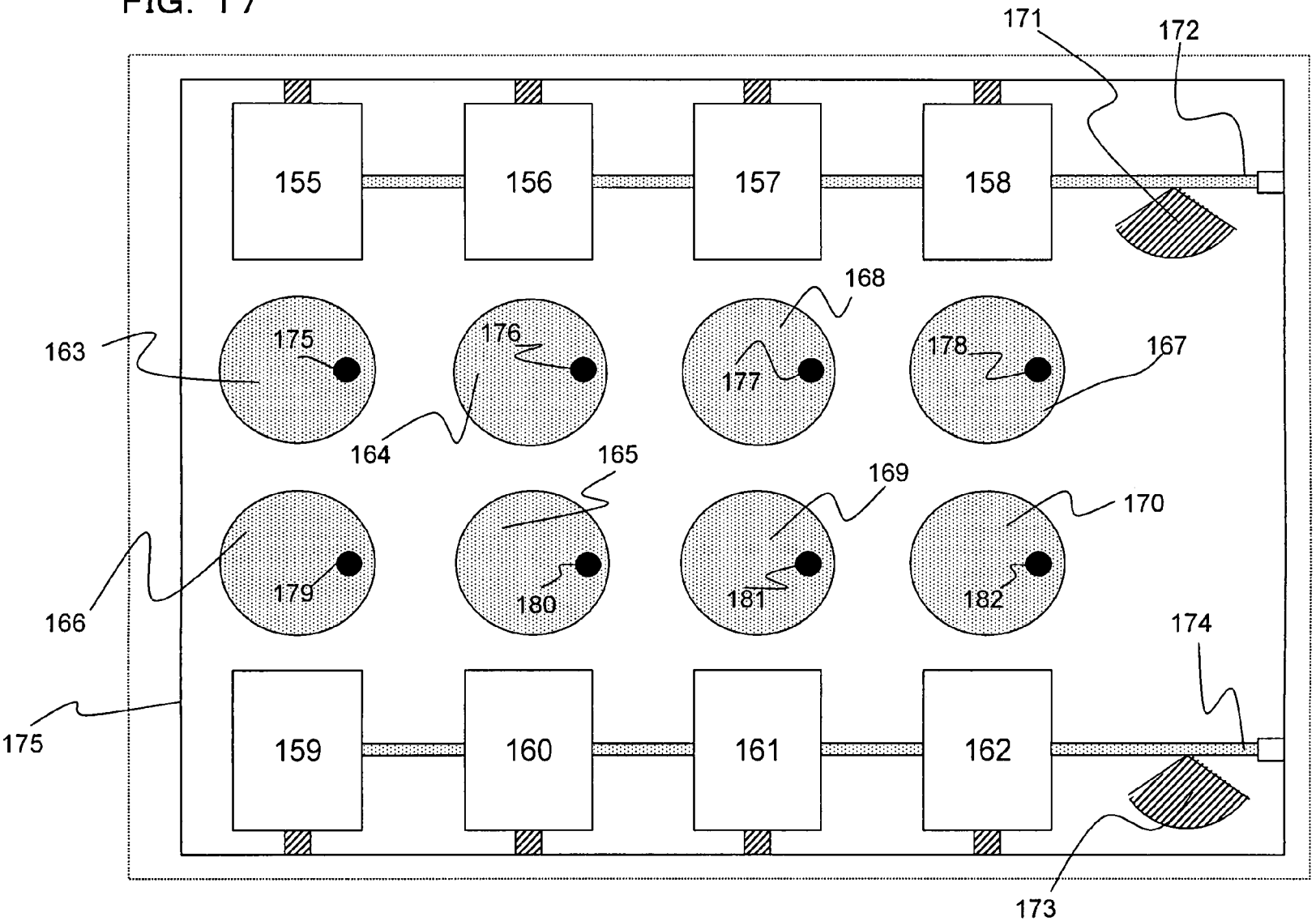
FIG. 17 diagrammatically illustrates a substrate of a ninth embodiment.
Figure 18:
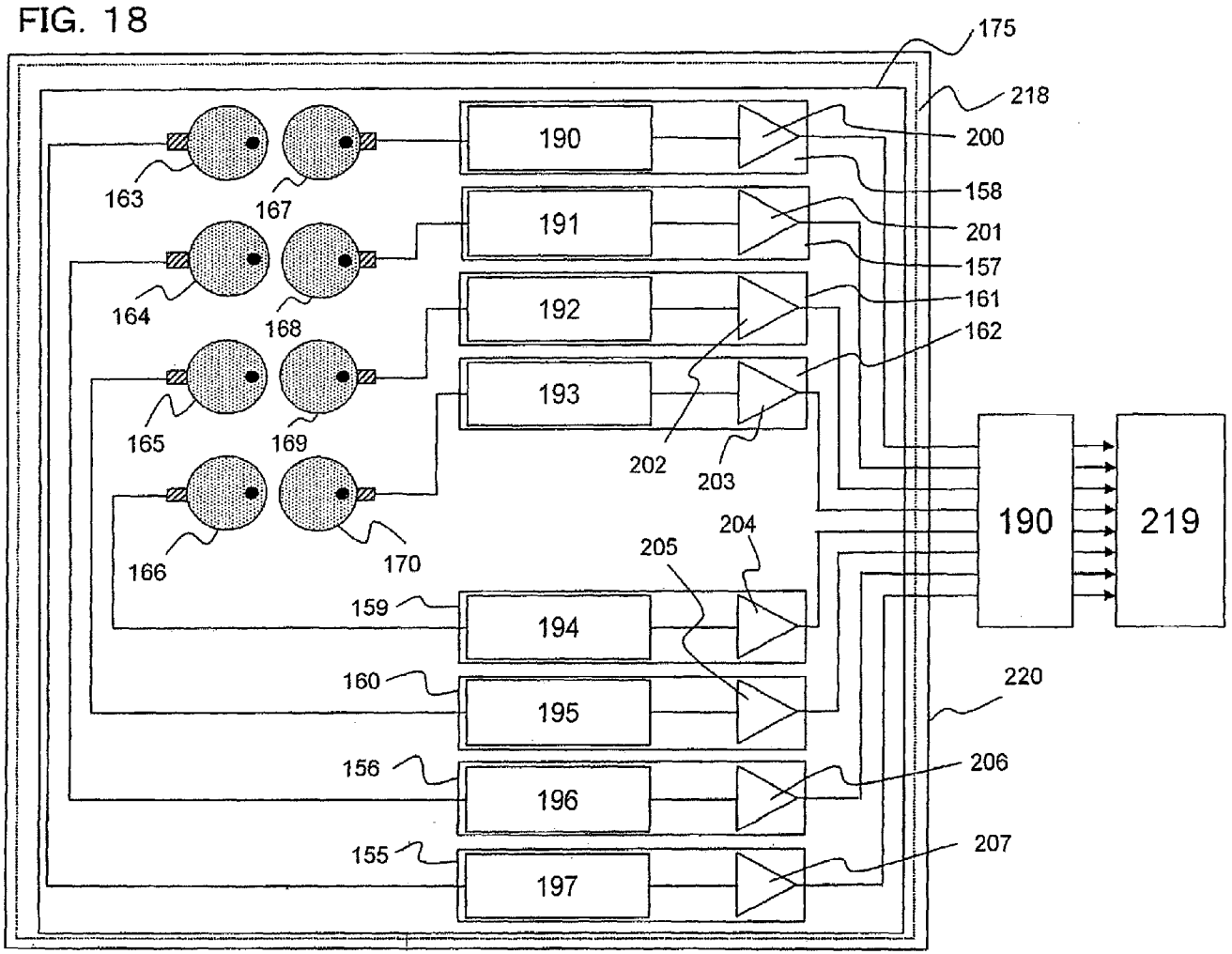
FIG. 18 is a block diagram of a receiver of the ninth embodiment.
Figure 19:
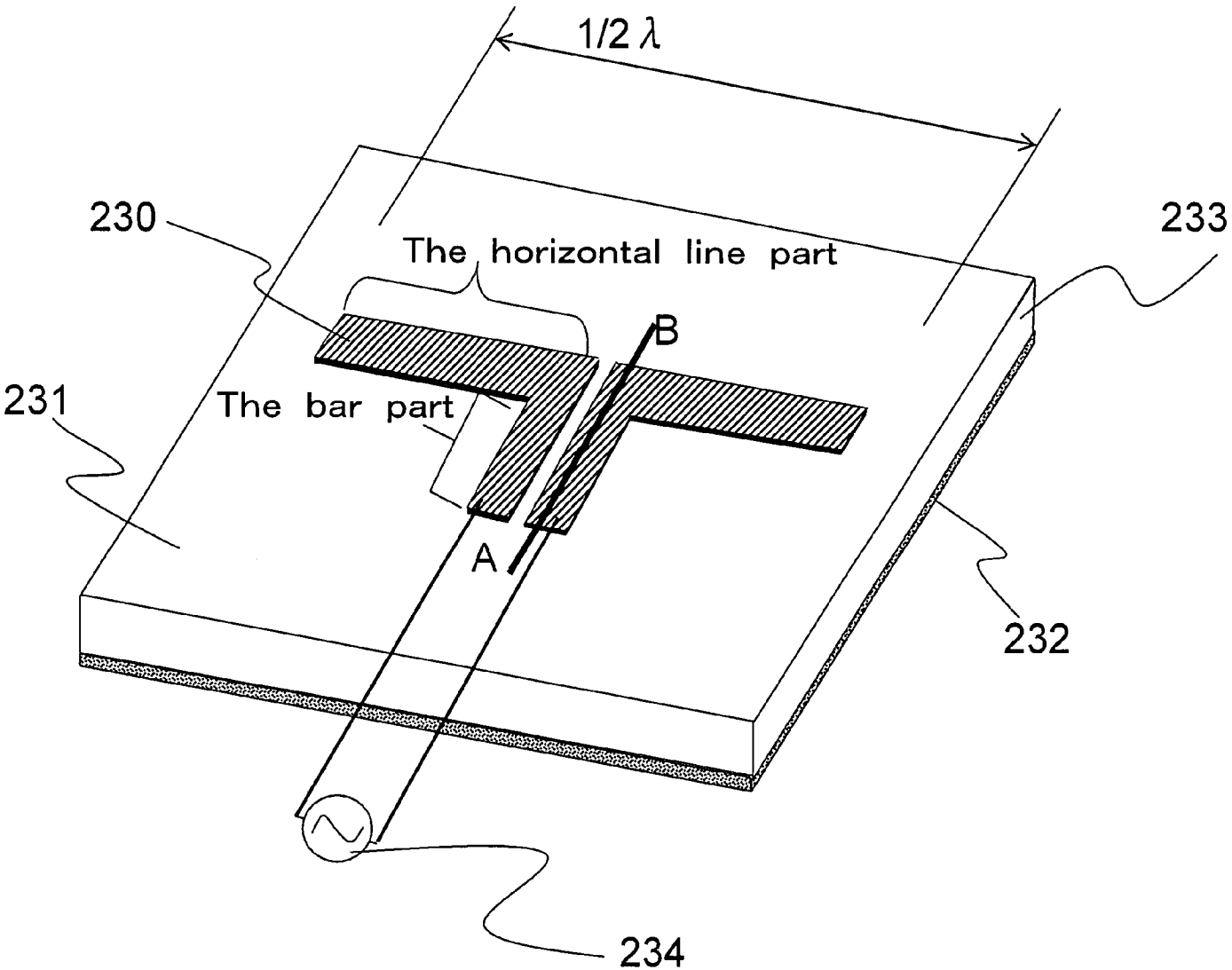
FIG. 19 diagrammatically illustrates antenna elements made of a superconducting material in accordance with a tenth embodiment.
Figure 20:
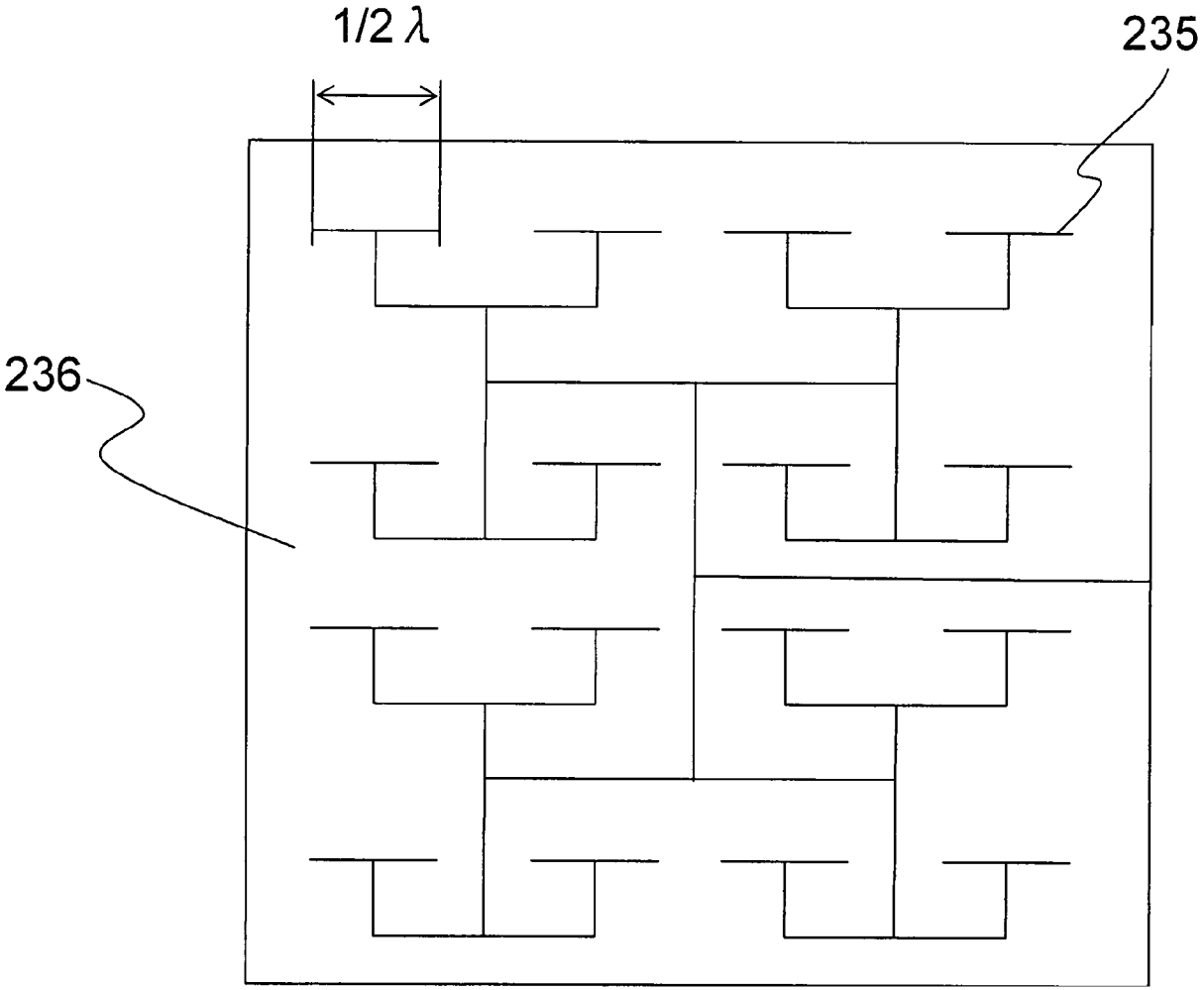
FIG. 20 diagrammatically illustrates linear-type antenna elements of the tenth embodiment.
Figure 21:
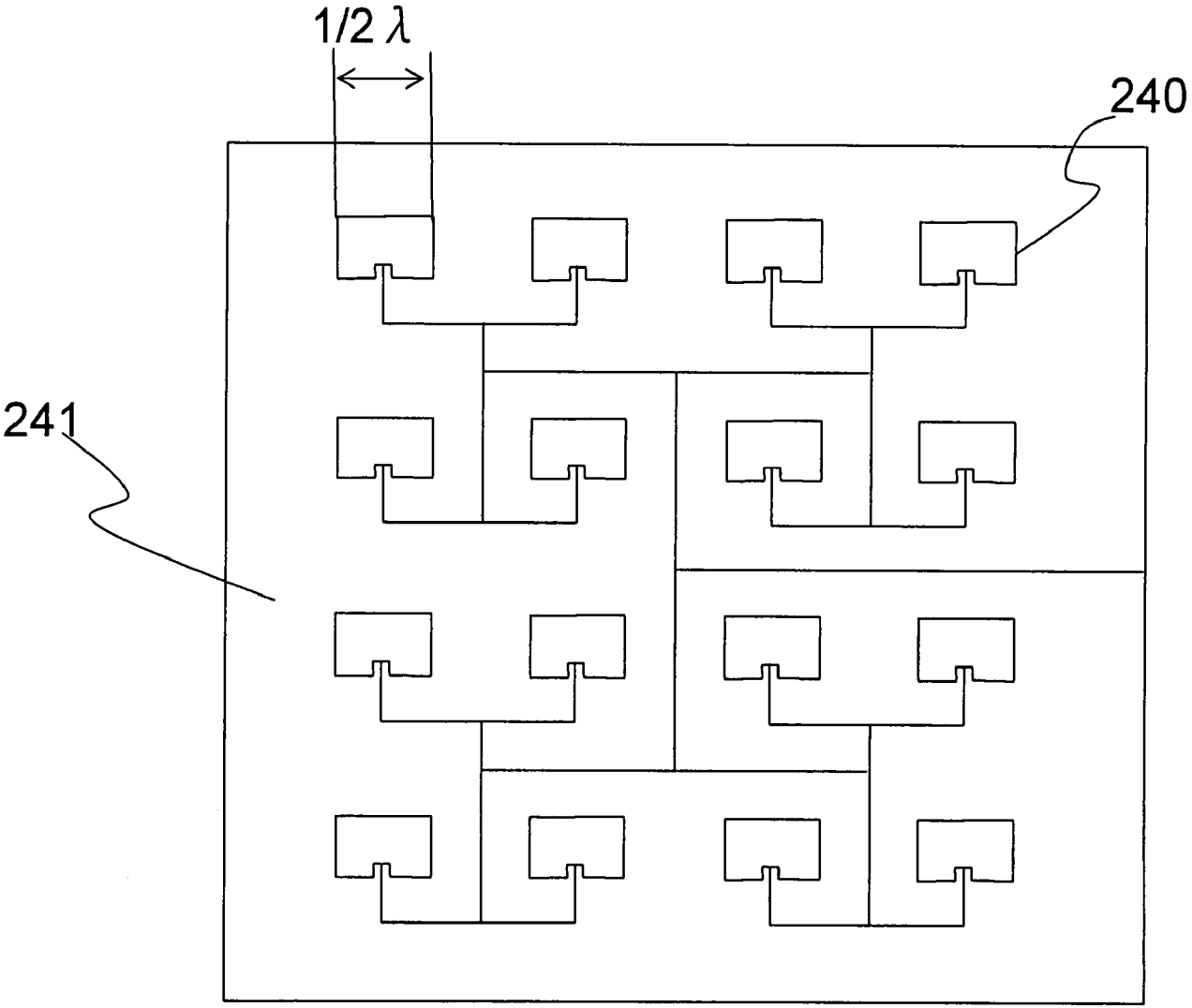
FIG. 21 diagrammatically illustrates patch-type antenna elements of the tenth embodiment.
Figure 22:
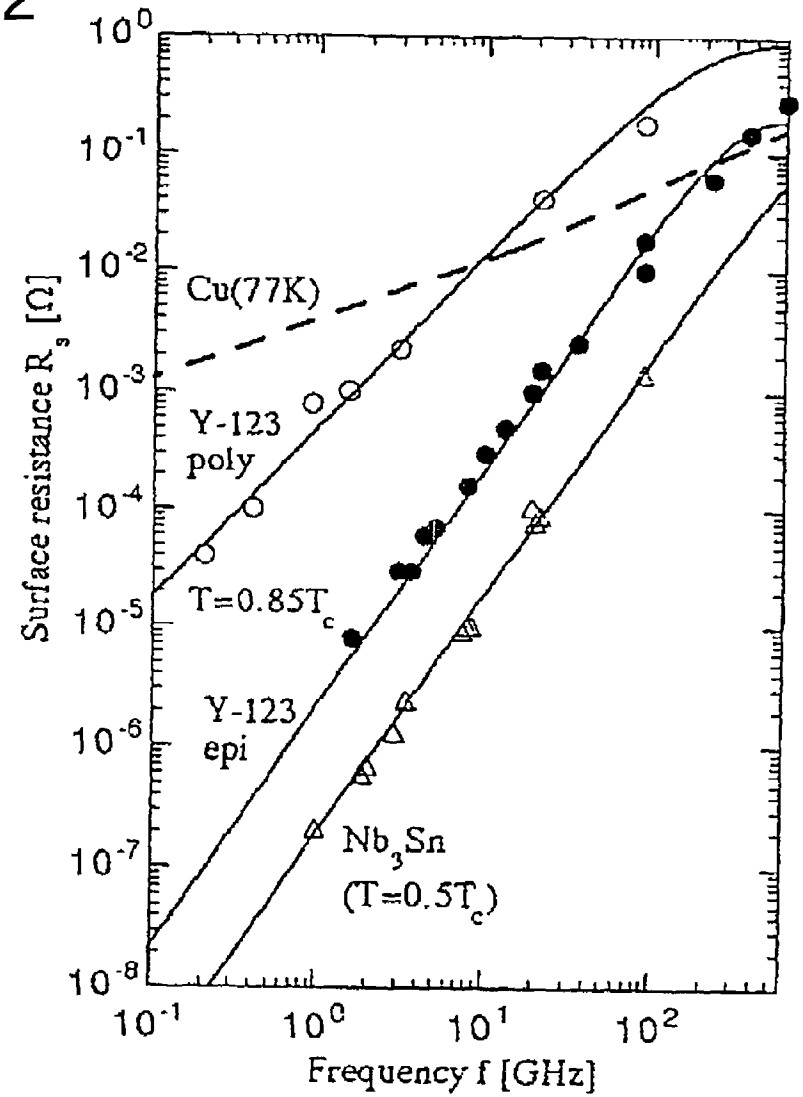
FIG. 22 illustrates a frequency-dependent surface resistance of a superconducting material.
Figure 23:
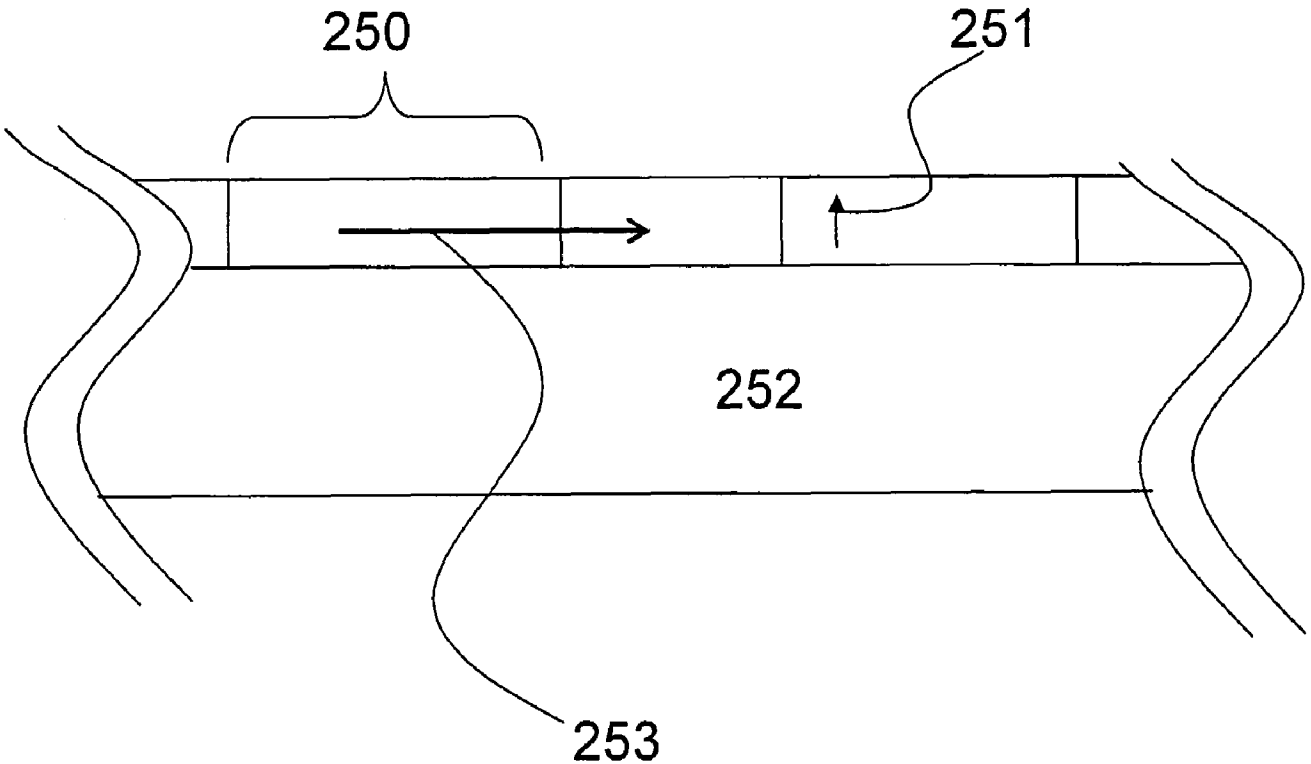
FIG. 23 is a sectional view of antenna elements of the tenth embodiment taken along A-B section.
Figure 24:
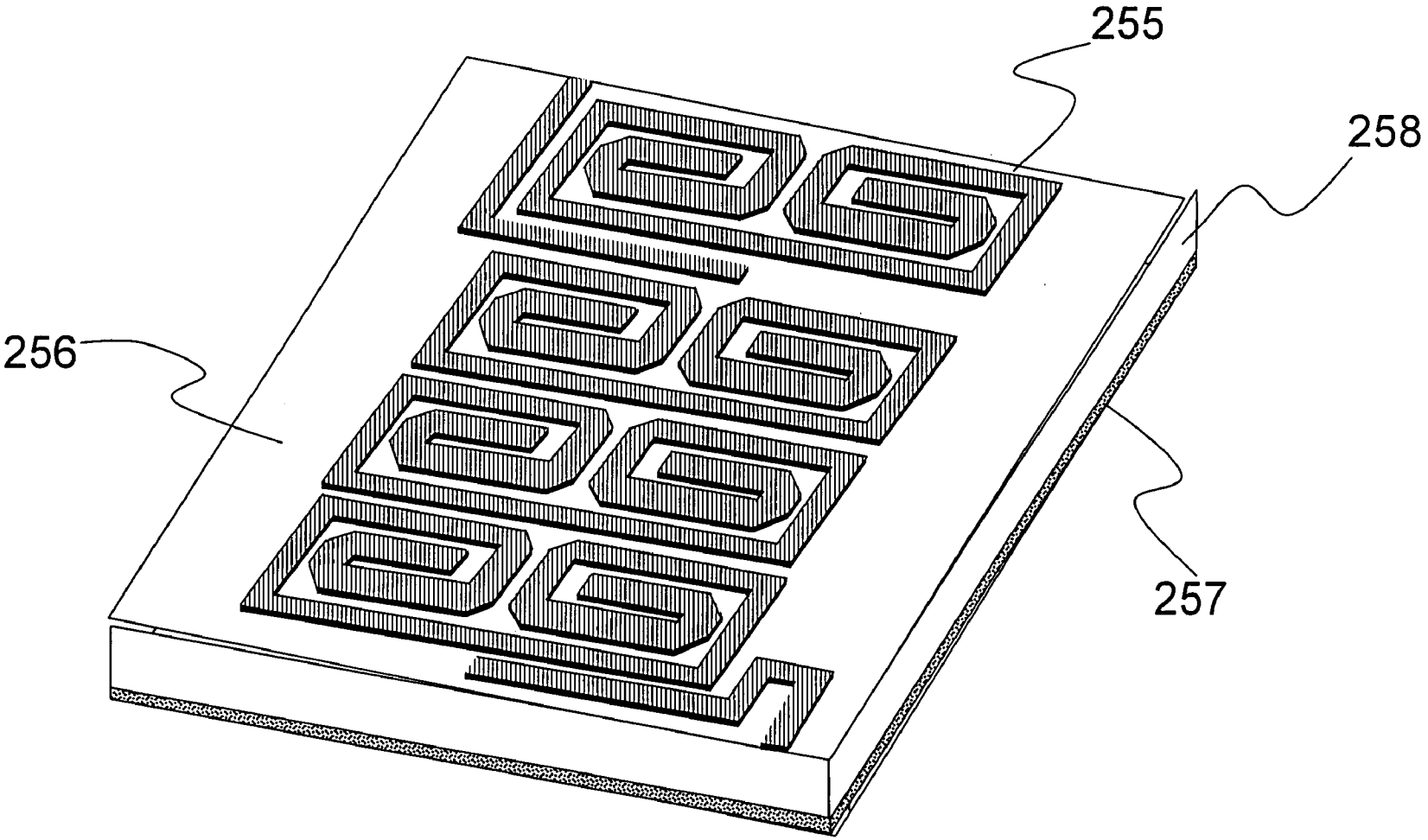
FIG. 24 illustrates a pattern of a BPF element of an eleventh embodiment.
Figure 25:
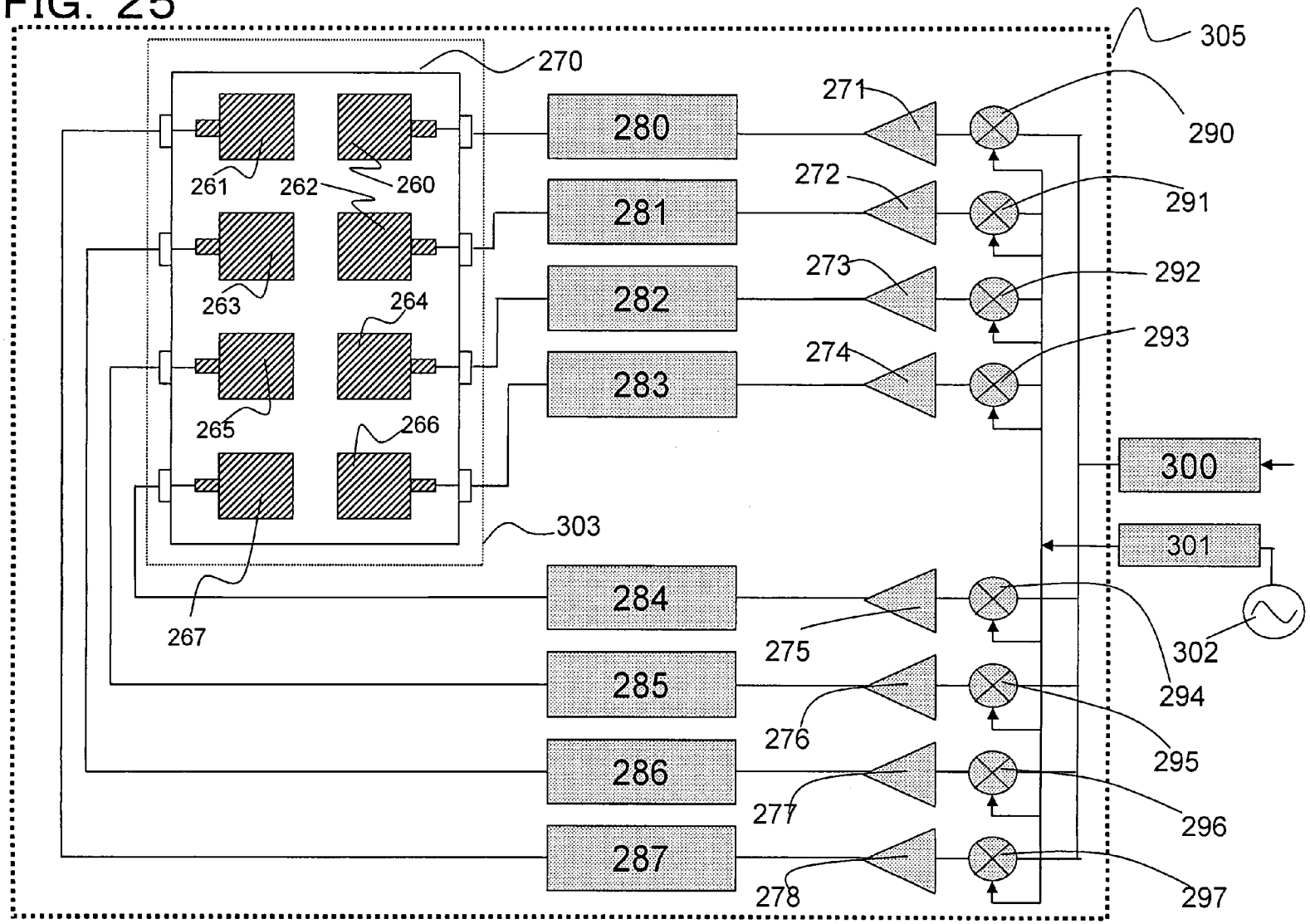
FIG. 25 is a block diagram of a transmitter of a twelfth embodiment.
Figure 26:
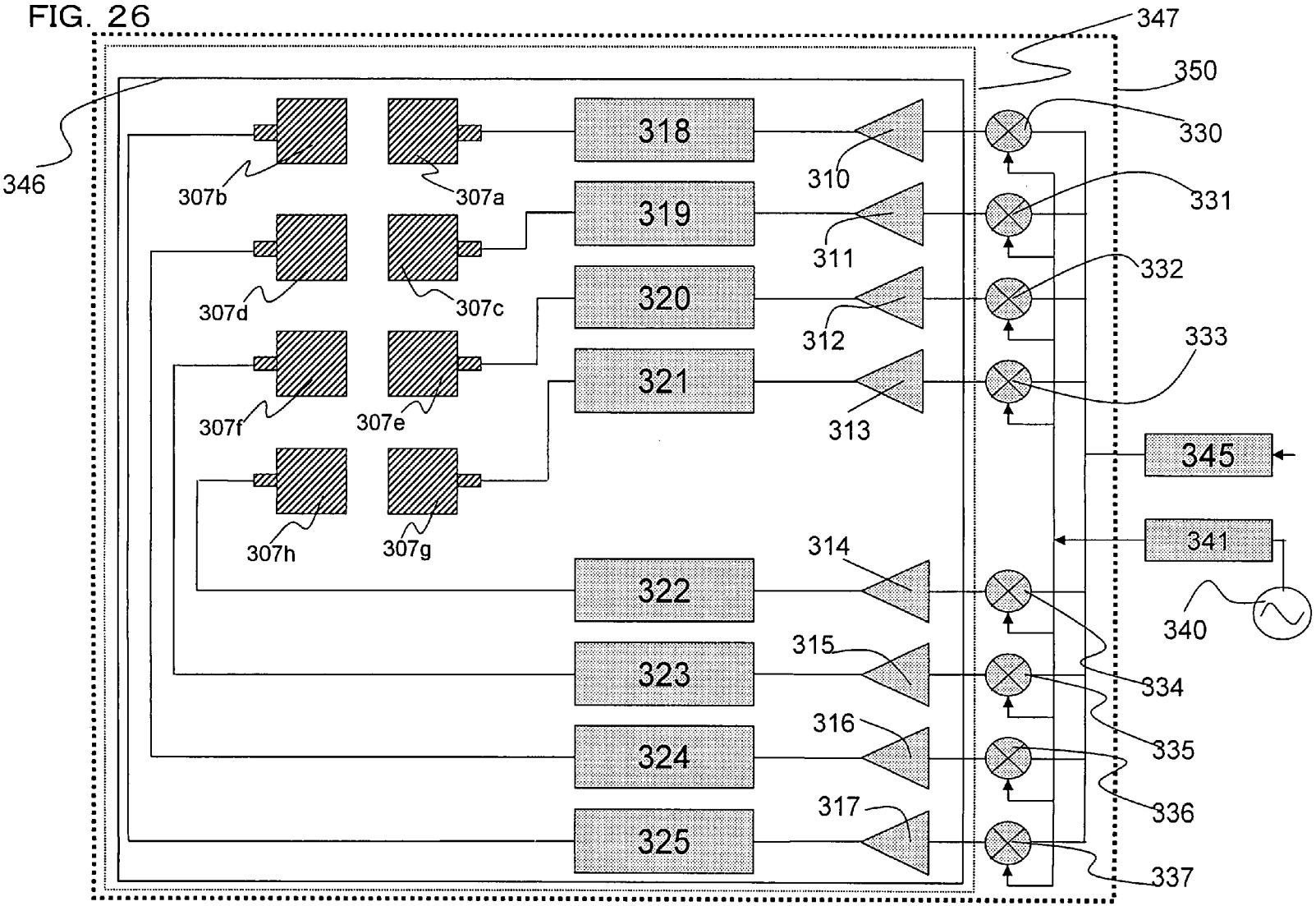
FIG. 26 is a block diagram of a thirteenth embodiment.

1 RF connector
2 Cable
3 Micro-strip antenna
4 Cold stage
5 Antenna window
6 Jacket
14 Super insulation film
15 Compressor
16 RF connector
17 Cable
18 Shield
20 Antenna element
21 Radio-wave window
22 Waveguide
23 Lid O-ring
24 Lid
25 Lock screw
26 Substrate
27 Cold plate
28 Discharge port
29 Discharge port O-ring
30 Vacuum pump
31 Pipe
33 Body
34 Antenna element container
35 Antenna device
39 Vacuum valve
40 Antenna device
41 Body
42 Cable
43 RF connector
44 Lid
45 Radio-wave window
46 Lock screw
47 Waveguide
48 Antenna element
49 Shield
50 Cold plate
52 Antenna element container
56 Body
57 Cable
58 Lid
59 Radio-wave window
60 RF connector
61 Lock screw
62 Waveguide
62*a* First opening
62*b* Second opening
63 Antenna element
64 Shield
65 Cold plate
68 External waveguide
70 Body
71 Shield
72 Antenna element
73 Radio-wave window
74 Waveguide
75 Lid O-ring
76 Cold plate
77 Lid
78 Substrate
79 Lock screw
80*a*, 80*b*, 80*c*, 80*d*, 80*e*, 80*f*, 80*g*, and 80*h* Antenna elements
83, 84, 85, 86, 87, 88, 89, and 90 BPFs
91*a*, 91*b*, 91*c*, 92*d*, 91*e*, 91*f*, 91*g* and 91*h* Low-noise amplifiers
93 IF
95 Signal processor circuit
100, 101, 102, 103, 104, 105, 106, and 107 Receiver circuits
108, 109, 110, and 111 Antenna elements
112 Shield
113, 114, 115, and 116 Antenna elements
117 and 122 Feeder patterns
120 and 121 Bias tee patterns
133, 134, 135, 135, 137, 138, 139, and 140 BPFs
141, 142, 143, 144, 145, 146, 147 and 148 Low-noise amplifiers
149 Substrate
150 IF
151 Signal processor circuit
152 Antenna element container
155, 156, 157, 158, 159, 160, 161 and 162 Receiver circuits
163, 164, 165, 166, 167, 168, 169 and 170 Antenna elements
171 and 173 Bias tee patterns
172 and 174 Feeder patterns
175 Substrate
190, 191, 192, 193, 194, 195, 196 and 197 BPFs
198 IF
200, 201, 202, 203, 204, 205, 206 and 207 Low-noise amplifiers
219 Signal processor circuit
230 Antenna pattern
231 Substrate
232 Ground conductor
233 Antenna element
234 Feeding
235 Antenna pattern
236 Substrate
240 Antenna pattern
241 Substrate
250 Grain
251 C-axis
252 MgO (100) substrate
253 A-axis or b-axis
255 BPF pattern
256 Substrate
257 Ground conductor
258 BPF element
260, 261, 262, 263, 264, 265, 266 and 267 Antenna elements
270 Substrate
271, 272, 273, 274, 275, 276, 277 and 278 Amplifiers
280, 281, 282, 283, 284, 285, 286 and 287 BPFs
290, 291, 292, 293, 294, 295, 296 and 297 Mixers
298 Antenna element container
300 IF
301 Frequency multiplier
302 Oscillator
305 Transmitter
310, 311, 312, 313, 314, 315, 316 and 317 Amplifiers
318, 319, 320, 321, 322, 323, 324 and 325 BPFs
330, 331, 332, 333, 334, 335, 336 and 337 Mixers
340 Oscillator

341 Frequency multiplier
345 IF
346 Substrate
347 Antenna element container
350 Transmitter
407 110.836 GHz signal from ozone molecules
408 Dish antenna
409 λ/4 plate
410 Fixed mirror
411 Second oscillator
412 Third oscillator
413 Intermediate frequency signal processor
414 AOS
415 Waveguide
416 CGC
417 SIS mixer
418 Intermediate frequency amplifier
419 Cooling load
420 Radiation shield
421 Frequency multiplier
422 Gunn oscillator
423 Harmonic mixer
424 Reference oscillator
425 Personal computer
426 Phase-locked controller
427 First oscillator
428 Main receiver unit

The invention claimed is:

1. An antenna device comprising:

a plane-type antenna element, a heat insulation container for blocking heat entering from the outside, the heat insulation container having a radio-wave window allowing a radio wave to pass therethrough, and housing the plane-type antenna element, a waveguide housed in the heat insulation container and arranged between the radio-wave window and an antenna pattern formation surface of the plane-type antenna element, and a cooling device cooling the plane-type antenna element.

2. The antenna device as claimed in claim 1, wherein the waveguide is housed in the heat insulation container and arranged between the radio-wave window and an antenna pattern formation surface of the plane-type antenna element in a manner such that an opening of the waveguide faces the plane-type antenna element.

3. The antenna device as claimed in claim 2, wherein the surface of the waveguide having the opening is spaced from the antenna pattern formation surface of the plane-type antenna element, and wherein a distance between the surface of the waveguide having the opening and the antenna pattern formation surface of the plane-type antenna element is equal to or shorter than the quotient that is obtained by dividing a quarter of the wavelength of the received radio wave by $\sqrt{A}$ where A represents an effective specific dielectric constant between the opening of the waveguide and the antenna pattern formation surface of the plane-type antenna element.

4. The antenna device as claimed in claim 1, wherein a plurality of plane-type antenna elements are housed in the heat insulation container and operatively connected to each other.

5. The antenna device according to claim 4, wherein waveguides are arranged with one independent of another waveguide with the number of waveguides dependent of the number of plane-type antenna elements.

6. The antenna device according to claim 5, wherein the plane-type antenna element has a circular antenna pattern, and wherein the plane-type antenna element has a single feeder point off-centered from the center of the antenna pattern.

7. The antenna device according to claim 1, wherein a sum of opening areas of the radio-wave windows is smaller than a sum of areas of the antenna patterns of the plane-type antenna elements, and wherein a specific dielectric constant of a plate fitted into the radio-wave window equals a specific dielectric constant of a material forming the waveguide.

8. The antenna device according to claim 7, wherein the waveguide has an opening having the same shape as the radio-wave window and in contact with the radio-wave window and an opening having the same shape as the antenna pattern of the plane-type antenna element and in contact with the plane-type antenna element.

9. An antenna device as claimed in claim 1, further comprising:

a first waveguide housed in the heat insulation container and arranged between the radio-wave window and an antenna pattern formation surface of the plane-type antenna element, and a second waveguide external to the heat insulation container and arranged in a manner such that one opening of the second waveguide is in contact with the radio-wave window.

10. The antenna device as claimed in claim 1, wherein an antenna pattern of the plane-type antenna element is a film made of at least one superconducting material selected from the group consisting of an REBCO system, a BSCCO system, and a PBSCCO system.

11. The antenna device according to claim 10, wherein the film made of the superconducting material includes c-axis oriented grains in a direction vertical to a substrate having the film of the superconducting material thereon, and wherein one of an a-axis and a b-axis of adjacent grains is oriented in the same direction.

12. The antenna device as claimed in claim 1, wherein the heat insulation container includes a heat insulation material wrapping around the plane-type antenna element.

13. A radio-wave receiver comprising:

a plane-type antenna element, a reception signal processor circuit for processing a signal from a radio wave received by the plane-type antenna element, a heat insulation container for blocking heat entering from the outside, the heat insulation container having a radio-wave window allowing a radio wave to pass therethrough, and housing the plane-type antenna element and the reception signal processor circuit, a waveguide housed in the heat insulation container and arranged between the radio-wave window and an antenna pattern formation surface of the plane-type antenna element, and a cooling device cooling the plane-type antenna element and the reception signal processor circuit.

14. A radio-wave transmitter comprising:

a plane-type antenna element, a transmission signal processor circuit for processing a signal to be carried by a radio wave transmitted by the plane-type antenna element, a heat insulation container for blocking heat entering from the outside, the heat insulation container having a radio-wave window allowing a radio wave to pass therethrough, and housing the plane-type antenna element and the transmission signal processor circuit, a waveguide housed in the heat insulation container and arranged between the radio-wave window and an antenna pattern formation surface of the plane-type antenna element, and a cooling device cooling the plane-type antenna element and the transmission signal processor circuit.

15. The radio-wave receiver according to claim 13, wherein the reception signal processor circuit includes an amplifier circuit and a filter circuit.

16. The radio-wave transmitter according to claim 14, wherein the transmission signal processor circuit includes an amplifier circuit and a filter circuit.

17. The radio-wave receiver according to claim 13, wherein an antenna pattern of the plane-type antenna element is a film made of at least one superconducting material selected from the group consisting of an REBCO system, a BSCCO system, and a PBSCCO system, wherein the film made of the superconducting material includes c-axis oriented grains in a direction vertical to a substrate having the film of the superconducting material thereon, and wherein one of an a-axis and a b-axis of adjacent grains is oriented in the same direction.

18. The radio-wave transmitter according to claim 14, wherein an antenna pattern of the plane-type antenna element is a film made of at least one superconducting material selected from the group consisting of an REBCO system, a BSCCO system, and a PBSCCO system, wherein the film made of the superconducting material includes c-axis oriented grains in a direction vertical to a substrate having the film of the superconducting material thereon, and wherein one of an a-axis and a b-axis of adjacent grains is oriented in the same direction.

19. The radio-wave receiver according to claim 13, wherein the heat insulation container includes a heat insulation material wrapping around the plane-type antenna element and the reception signal processor circuit.

20. The radio-wave transmitter according to claim 14, wherein the heat-insulation container includes a heat insulation material wrapping around the plane-type antenna element and the transmission signal processor circuit.

* * * * *